US010336484B2

(12) United States Patent
Haigh et al.

(10) Patent No.: US 10,336,484 B2
(45) Date of Patent: Jul. 2, 2019

(54) APPARATUS AND METHOD FOR HELICALLY WRAPPING ARTICLES

(71) Applicant: Oakbridge Investments Limited, Huddersfield (GB)

(72) Inventors: Christopher Timothy Haigh, Huddersfield (GB); Alan James Read, Lancashire (GB)

(73) Assignee: OAKBRIDGE INVESTMENTS LIMITED, Huddersfield (GB)

( * ) Notice: Subject to any disclaimer, the term of this patent is extended or adjusted under 35 U.S.C. 154(b) by 518 days.

(21) Appl. No.: 14/912,099

(22) PCT Filed: Aug. 18, 2014

(86) PCT No.: PCT/GB2014/052527
§ 371 (c)(1),
(2) Date: Feb. 15, 2016

(87) PCT Pub. No.: WO2015/025142
PCT Pub. Date: Feb. 26, 2015

(65) Prior Publication Data

US 2016/0200466 A1 Jul. 14, 2016

(30) Foreign Application Priority Data

Aug. 21, 2013 (GB) ..... 1314963.8

(51) Int. Cl.
*G06F 7/00* (2006.01)
*B65B 11/00* (2006.01)
(Continued)

(52) U.S. Cl.
CPC ..... *B65B 11/008* (2013.01); *B65B 35/10* (2013.01); *B65B 35/44* (2013.01); *B65B 57/14* (2013.01);
(Continued)

(58) Field of Classification Search
None
See application file for complete search history.

(56) References Cited

U.S. PATENT DOCUMENTS 4,050,220 A * 9/1977 Lancaster ..... B65B 11/008 493/299
4,878,337 A * 11/1989 Raudat ..... B65B 21/24 53/207
(Continued)

FOREIGN PATENT DOCUMENTS

CN 10 478 33 A 12/1990
CN 101 035 710 A 9/2007
(Continued)

OTHER PUBLICATIONS

International Search Report for PCT/GB2014/052527 dated Nov. 14, 2014, 5 pages.
(Continued)

*Primary Examiner* — Yolanda R Cumbess
(74) *Attorney, Agent, or Firm* — Klintworth & Rozenblat IP LLP

(57) ABSTRACT

A packaging apparatus (1) comprising: a wrapping material applicator (3) for helically wrapping articles (A); an inlet conveyor (2) for transporting unwrapped articles to the applicator; an outlet conveyor (4) for transporting wrapped articles away from the applicator; wherein the outlet conveyor comprises a first conveyor (11) and a second conveyor (12) adjacent to and downstream of the first conveyor (11), wherein the packaging apparatus (1) further comprises a controller (80) arranged to selectively vary the linear velocity of the second conveyor relative (12) to the linear velocity of the first conveyor (11) so as to separate, or increase the separation of, collations of one or more articles (A) on the outlet conveyor.

19 Claims, 11 Drawing Sheets

(51) Int. Cl.

| | |
|---|---|
| ***B65B 35/10*** | (2006.01) |
| ***B65B 61/06*** | (2006.01) |
| ***B65B 35/44*** | (2006.01) |
| ***B65B 57/14*** | (2006.01) |
| ***B65B 57/16*** | (2006.01) |
| ***B65B 59/02*** | (2006.01) |

(52) U.S. Cl.
CPC ..... *B65B 57/16* (2013.01); *B65B 59/02* (2013.01); *B65B 61/06* (2013.01)

(56) References Cited

U.S. PATENT DOCUMENTS

| | | | | |
|---|---|---|---|---|
| 5,038,915 | A | 8/1991 | Delsanto | |
| 5,138,815 | A | 8/1992 | Groschen, Jr. | |
| 5,140,800 | A * | 8/1992 | Martin | B26D 5/38 493/33 |
| 2001/0035332 | A1* | 11/2001 | Zeitler | B65G 43/08 198/464.3 |
| 2003/0183484 | A1* | 10/2003 | Peterman | B65B 35/405 198/419.1 |
| 2008/0082206 | A1 | 4/2008 | Egami et al. | |
| 2011/0061339 | A1 | 3/2011 | Hartness et al. | |

FOREIGN PATENT DOCUMENTS

| | | | | |
|---|---|---|---|---|
| CN | 200 951 837 | Y | | 9/2007 |
| CN | 200951837 | Y | * | 9/2007 |
| DE | 3624445 | A1 | | 2/1988 |
| JP | 4 282 140 | B2 | | 6/2009 |
| WO | 90/09316 | A1 | | 8/1990 |
| WO | 2006/011022 | A2 | | 2/2006 |
| WO | 2006/051281 | A1 | | 5/2006 |
| WO | 2012/055490 | A1 | | 5/2012 |

OTHER PUBLICATIONS

International Search Report for GB1314963.8 dated Jan. 31, 2014, 2 pages.
Chinese Examination Report for Chinese Patent Application No. 2014800553366 dated Mar. 3, 2017, 20 pages.

* cited by examiner

D
$A_2^2$
11b
$A_1^2$
$L_2^1(l - Z)$
$Z L_2^1$
$A_1^1$
12b
15
5
11a
13
$A_2^1$
$E_T$
12a
$E_L$
14a
14b
16
C
G
$V_1$
$V_2$

APPARATUS AND METHOD FOR HELICALLY WRAPPING ARTICLES

The present invention relates to a method and apparatus for packaging collations of articles and more particularly, but not exclusively, to a method and apparatus for packaging together collations of articles in a production line environment.

It is known to package articles by wrapping them in flexible sheet material such as, for example, highly stretched synthetic plastics film. An article, or a group of articles, is typically enclosed between two sheets of material or a folded single sheet and the material is heat sealed at overlapping edges.

In a known helical wrapping machine articles are wrapped by winding a continuous web of wrapping material around the articles in a direction generally transverse to their direction of movement along the machine. This results in the articles being wrapped by a helical continuous web of material. The machine has an upstream conveyor that is separated from a downstream conveyor by a rotary ring-type web applicator whose rotary axis is generally parallel to the longitudinal axis of the conveyors. The articles are fed to the upstream conveyor by a feeder conveyor, that is typically perpendicular to the upstream conveyor, using a reciprocating push rod which separates the articles into separate collations by sequentially pushing a number of articles together at a time, to form a collation, from the feeder conveyor onto the upstream conveyor. The collations of articles on the upstream conveyor are spaced from each other as they travel towards the rotary web applicator.

As the collations of articles pass through applicator, its ring rotates at a predetermined speed and dispenses the wrapping material. As a result, the articles are wrapped by a continuous helical band of material. The wrapped articles pass to the downstream conveyor which carries them to a cutting station, whereby the wrapped collations of articles are separated into individually wrapped collations of articles by cutting through the adjoining wrapping between each collation.

Articles within each collation are usually secured together (for example on cardboard pallets and/or wrapped together by packaging tape) before wrapping. However, it may be desirable to wrap collations of articles together which are not secured together before they are wrapped, i.e. "unsecured collations". The wrapping material therefore serves both to protect the articles for shipping and to hold the articles together in collations. Wrapping collations of articles in this way means that no extra material is required to secure the articles together, which provides significant advantages in cost and efficiency during packaging and shipping. However, the lack of any securement allows the articles to move relative to one another as they approach the applicator and during the wrapping process, with the result that the wrapped articles may not be wrapped tightly together. In some cases, such as when the articles have a high centre of gravity, unsecured articles may even fall over before wrapping has occurred, causing costly stoppages in a production line environment.

Furthermore, since the gaps between the collations of articles are "wrapped", this results in a significant wastage of wrapping material.

In addition, the apparatus required for the reciprocating push rod necessary to separate the articles into collations of articles is relatively large and expensive. In addition, due to its reciprocating motion, it is a relatively slow and discontinuous arrangement and is prone to failure.

Accordingly, it is an object of the present invention to obviate or mitigate at least some of the problems which are apparent from the above.

According to a first aspect of the present invention there is provided packaging apparatus comprising: a wrapping material applicator for helically wrapping articles; an inlet conveyor for transporting unwrapped articles to the applicator; an outlet conveyor for transporting wrapped articles away from the applicator; wherein the outlet conveyor comprises a first conveyor and a second conveyor adjacent to and downstream of the first conveyor, wherein the packaging apparatus further comprises a controller arranged to selectively vary the linear velocity of the second conveyor relative to the linear velocity of the first conveyor so as to separate, or increase the separation of, collations of one or more articles on the outlet conveyor.

This is advantageous in that articles can be separated into separate collations of one or more articles on the outlet conveyor. This means that the articles do not have to be separated into separate collations of articles on the inlet conveyor, thereby allowing the articles to be fed from the inlet conveyor to the applicator in a substantially continuous stream. This produces a substantial saving in wrapping material since there are substantially no gaps between successive collations of articles that are "wrapped". In addition, since the articles are in a substantially continuous stream, they are less susceptible to being twisted or toppled when being wrapped by the applicator. This results in a tighter and more efficient wrapping of the articles.

In addition, this removes the need for a bulky and expensive reciprocating pusher arrangement which may otherwise be needed in order to separate the articles into separate collations of articles.

Preferably the controller is arranged to selectively vary the linear velocity of the second conveyor relative to the linear velocity of the first conveyor so as to separate, or increase the separation of, collations of one or more articles on, or partly on, the second conveyor from articles on, or partly on, the first conveyor.

Preferably the inlet conveyor is for transporting unsecured articles to the applicator.

Preferably the inlet conveyor is for transporting a substantially continuous stream of articles to the applicator.

Preferably the packaging apparatus comprises a feeder mechanism arranged to feed articles to the inlet conveyor in a substantially continuous stream, In this respect, the articles on the inlet conveyor that are adjacent to each other in the direction of the longitudinal axis of the inlet conveyor are preferably in contact with each other. There is preferably substantially no separation between articles that are adjacent to each other in the direction of the longitudinal axis of the inlet conveyor.

In this case, the linear velocity of the second conveyor is selectively variable relative to the linear velocity of the first conveyor so as to separate collations of articles on the outlet conveyor (as opposed to increasing the separation of collations).

The articles may be arranged in a single file or in a plurality of laterally adjacent longitudinal rows. Where the articles are arranged in a plurality of laterally adjacent rows, longitudinally adjacent articles in the same longitudinal row and/or adjacent longitudinal rows may be in contact with each other so as to form a substantially continuous stream. Preferably longitudinally adjacent articles in the same longitudinal row are in contact with each other so as to form a substantially continuous stream.

The linear velocity of the second conveyor relative to the linear velocity of the first conveyor may be selectively varied by varying the respective linear velocities of the first and/or second conveyors. Preferably the linear velocity of the second conveyor relative to the linear velocity of the first conveyor is selectively varied by varying the linear velocity of the second conveyor and maintaining the linear velocity of the first conveyor substantially constant as the linear velocity of the second conveyor is varied.

Preferably the controller is arranged to carry out a method comprising the following steps:

1) the linear velocity ($V_2$) of the second conveyor is set to and substantially maintained at the linear velocity of the first conveyor ($V_1$), whereby a collation (n) of one or more articles ($A_1^n$ to $A_W^n$) is at least partially received by the second conveyor from the first conveyor;
2) once a proportion 'z' (where $0<z\leq 1$) of the length ($L_W^n$) of the last article ($A_W^n$), or the last lateral row of articles, of the collation (n) is received by the second conveyor, the linear velocity ($V_2$) of the second conveyor is increased to a value $V_{2inc}$;
3) the second conveyor is maintained at the increased value ($V_{2inc}$) until the first article, or lateral row of articles, of the next upstream collation ($A_1^{n+1}$), reaches the upstream end of the second outlet conveyor, so as to produce a gap of a desired length (G) between the last article ($A_W^n$), or the last lateral row of articles, of the collation (n), and the first article, or the first lateral row of articles, of the next upstream collation ($A_1^{n+1}$) at this point in time, following which the sequence returns to the first step (with n=n+1).

Where the articles are arranged in a single file, '$A_x^y$' refers to each article, where 'x' corresponds to the upstream position of the article in the respective collation and 'y' corresponds to the upstream position of the collation. The value of 'W' is the desired number of articles in each collation (n).

Where the articles are in a plurality of longitudinal rows, the articles form a plurality of longitudinally adjacent lateral rows each of a plurality of articles. In this case, '$A_x^y$' refers to each lateral row, where 'x' corresponds to the upstream position of the lateral row in the respective collation and 'y' corresponds to the upstream position of the collation. The value of W is the desired number of lateral rows of articles in each collation (y).

Preferably the above three steps are then repeated in sequence for each collation of one or more articles $A_x^y$ (i.e. where x varies from 1 to W, for each value of y) so as to separate the remaining upstream articles $A_x^y$ into separate collations spaced apart by a gap (G).

Each collation of articles may comprise one or more articles, or lateral rows of articles. Preferably each collation of articles comprises a plurality of articles, or lateral rows of articles.

Each collation may have the same or different numbers of articles, or lateral rows of articles (W).

The changes in the linear velocity of the second outlet conveyor $V_2$ from $V_1$ to $V_{2inc}$ and back again are preferably step changes in velocity, i.e. these changes in velocity are substantially instantaneous.

Preferably for the collation (n), the time $T_{V1}$ at which V2=V1 is calculated by:

$$T_{V1} = \frac{L_1^n + L_2^n + \ldots\ L_{W-1}^n + (z \times L_W^n)}{V_1}$$

$L_x^y$ is the length of each article, or lateral row of articles, (x) of each collation (y).

Preferably for the collation (n) the time ($T_{V2inc}$) that the second conveyor is maintained at the increased value ($V_{2inc}$) is calculated by the central processing unit from the equation:

$$T_{V2inc} = \frac{L_W^n \times (1 - z)}{V_1}$$

Preferably $V_{2inc}$ is calculated by the central processing unit from the equation:

$$V_{2inc} = V_1 * \left(1 + \frac{G}{L_W^n(1 - z)}\right)$$

Preferably the packaging apparatus further comprises at least one sensor arranged to sense the position and/or length of the articles. Preferably the controller is arranged to selectively vary the linear velocity of the second conveyor relative to the linear velocity of the first conveyor in dependence on the sensed positions and/or lengths of the articles, so as to separate, or increase the separation of collations of one or more articles on the outlet conveyor.

The at least one sensor may be arranged to sense the position and/or length of the articles on the inlet or outlet conveyors. Preferably the at least one sensor is arranged to sense the position and/or length of articles on the first outlet conveyor.

Preferably the at least one sensor is connected to the controller via a central processing unit. Preferably the at least one sensor is arranged to determine the points in time at which leading and trailing edges of the articles pass a certain point and the central processing unit is arranged to calculate the lengths of the articles, from these time values. Preferably the central processing unit is arranged to count the number of articles that pass said point.

The at least one sensor may be any suitable type of position sensor. The at least one sensor is preferably an optical sensor. The at least one sensor may be of any suitable type, including a photodiode array, an infrared proximity sensor, etc.

Since the articles on the outlet conveyor have been wrapped by the applicator, when they were in a continuous stream, this creates, or increases, a gap between collations of wrapped articles, resulting in a stretching of the applied wrapping material between successive collations of articles. Preferably the wrapping material is of a material that is sufficiently stretchable in the longitudinal direction to allow the collations to be spaced apart by said gap.

Preferably the packaging apparatus comprises a cutting member arranged to cut wrapping material extending between the spaced collations of articles, as gaps between the collations pass the cutting member, so as to disconnect the spaced collations of articles.

Preferably the cutting member is controlled by a controller. The controller may be the same as, or different to, the controller arranged to selectively vary the linear velocity of the second conveyor relative to the linear velocity of the first conveyor said controller.

The cutting member may be of any suitable type, including a blade, hot wire, etc.

Preferably the packaging apparatus comprises at least one gap measurement sensor arranged to measure gaps between the spaced collations of articles on the second conveyor, the central processing unit is arranged to calculate the time it will take the measured gap to travel the distance from the at least one gap measurement sensor to the cutting member and the controller is arranged such that the cutting member cuts as gaps between the collations pass the cutting member.

Preferably the packaging apparatus comprises at least one gap detector sensor arranged to detect whether or not there is gap between collations of articles on the second conveyor immediately prior to the gap passing the cutting station and the central processing unit and controller are arranged such that if the gap is not detected to be in the correct location, then the cutting member is not operated to cut.

Preferably the first and second conveyors of the outlet conveyor are disposed between the applicator and the cutting member.

The packaging apparatus may comprise a discharge conveyor disposed downstream of and adjacent to the second conveyor of the outlet conveyor such that collations of articles on the second conveyor pass on to the discharge conveyor. A gap is preferably provided between the discharge conveyor and the second conveyor. The cutting member is preferably disposed such that it cuts within said gap.

Preferably the first and second conveyors of the outlet conveyor are separated by a gap. Preferably the first and second conveyors are movable relative to each other such that the gap between the first and second conveyors is variable.

Each of the first and/or second conveyors may comprise a pair of opposed spaced apart conveyors for receiving the articles between them. The opposed conveyors are preferably arranged to apply a frictional grip to the articles on the conveyors such that unwanted separation of articles on the conveyors, as the linear velocity of the second conveyor is selectively varied relative to the linear velocity of the first conveyor, is substantially prevented. In this respect, the opposed conveyors are preferably arranged to apply a frictional grip to the articles on the conveyors such that separation between articles, other than the desired separation between longitudinally adjacent articles in adjacent collations that are separated as the linear velocity of the second conveyor is selectively varied relative to the linear velocity of the first conveyor, is substantially prevented.

The opposed conveyors may be movable relative to each other so as to vary their spacing so as to accommodate different sized articles. The opposed conveyors may be aligned in the longitudinal direction. The opposed conveyors may be vertically spaced from each other to form upper and lower conveyors.

The inlet conveyor and the first conveyor of the outlet conveyor may be formed by a single conveyor. Preferably the inlet conveyor and the first conveyor of the outlet conveyor are separate conveyors. In this case, the inlet conveyor and the first conveyor of the outlet conveyor are preferably spaced apart by a gap, with the applicator provided in the gap.

According to a second aspect of the present invention there is provided a method for helically wrapping together a collation of articles, the method comprising: transporting unwrapped articles to a wrapping applicator with an inlet conveyor; helically wrapping the collations of articles with wrapping material by operating the wrapping applicator; conveying wrapped collations of articles away from the applicator with an outlet conveyor wherein the outlet conveyor comprises a first conveyor and a second conveyor adjacent to and downstream of the first conveyor and wherein the linear velocity of the second conveyor relative to the linear velocity of the first conveyor is selectively varied so as to separate, or increase the separation of, collations of one or more articles on the outlet conveyor.

Preferably the articles on the inlet conveyor are in a substantially continuous stream.

Preferably the articles wrapped by the applicator are in a substantially continuous stream.

Preferably the articles that are conveyed to the wrapping applicator by the inlet conveyor are unsecured. In this respect, the articles are preferably not secured together before they are wrapped by the wrapping material applicator.

Preferably the linear velocity of the second conveyor relative to the linear velocity of the first conveyor is selectively varied so as to so as to separate, or increase the separation of collations of one or more articles on, or partly on, the second conveyor from articles on, or partly on, the first conveyor.

The linear velocity of the second conveyor relative to the linear velocity of the first conveyor may be selectively varied by varying the respective linear velocities of the first and/or second conveyors. Preferably the linear velocity of the second conveyor relative to the linear velocity of the first conveyor is selectively varied by varying the linear velocity of the second conveyor while maintaining the linear velocity of the first conveyor substantially constant.

Preferably the method comprises the following steps:

1) the linear velocity ($V_2$) of the second conveyor is set to and substantially maintained at the linear velocity of the first conveyor ($V_1$), whereby a collation (n) of one or more articles ($A_1^n$ to $A_W^n$) is at least partially received by the second conveyor from the first conveyor;
2) once a proportion 'z' (where $0<z\leq 1$) of the length ($L_W^n$) of the last article ($A_W^n$), or the last lateral row of articles, of the collation (n) is received by the second conveyor, the linear velocity ($V_2$) of the second conveyor is increased to a value $V_{2inc}$;
3) the second conveyor is maintained at the increased value ($V_{2inc}$) until the first article, or lateral row of articles, of the next upstream collation ($A_1^{n+1}$), reaches the upstream end of the second outlet conveyor, so as to produce a gap of a desired length (G) between the last article ($A_W^n$), or the last lateral row of articles, of the collation (n), and the first article, or the first lateral row of articles, of the next upstream collation ($A_1^{n+1}$) at this point in time, following which the sequence returns to the first step (with n=n+1).

Preferably the above three steps are then repeated in sequence for each collation of articles $A_x^y$ (i.e. where x varies from 1 to W, for each value of y) so as to separate the remaining upstream articles $A_x^y$ into separate collations spaced apart by a gap (G).

Each collation of articles may comprise one or more articles, or lateral rows of articles. Preferably each collation of articles comprises a plurality of articles, or lateral rows of articles.

Each collation may have the same or different numbers of articles, or lateral rows of articles (W).

The changes in the linear velocity of the second outlet conveyor $V_2$ from $V_1$ to $V_{2inc}$ and back again are preferably step changes in velocity, i.e. these changes in velocity are substantially instantaneous.

Preferably for the collation (n), the time $T_{V1}$ at which V2=V1 is calculated by:

$$T_{V1} = \frac{L_1^n + L_2^n + \ldots L_{W-1}^n + (z \times L_W^n)}{V_1}$$

$L_x^y$ is the length of each article, or lateral row of articles, (x) of each collation (y).

Preferably for the collation (n) the time ($T_{V2inc}$) that the second conveyor is maintained at the increased value ($V_{2inc}$) is calculated by:

$$T_{V2inc} = \frac{L_W^n \times (1 - z)}{V_1}$$

Preferably $V_{2inc}$ is calculated by the equation:

$$V_{2inc} = V_1 * \left(1 + \frac{G}{L_W^n(1 - z)}\right)$$

Preferably the linear velocity of the second conveyor relative to the linear velocity of the first conveyor is selectively varied by a controller.

Preferably the method comprises using at least one sensor to sense the position and/or length of the articles. Preferably the linear velocity of the second conveyor relative to the linear velocity of the first conveyor is selectively varied in dependence on the sensed positions and/or lengths of the articles, so as to separate, or increase the separation of collations of one or more articles on the outlet conveyor.

Preferably the at least one sensor is used to sense the position and/or length of the articles on the inlet or outlet conveyors. Preferably the at least one sensor is used to sense the position and/or length of articles on the first outlet conveyor.

Preferably the at least one sensor is connected to the controller via a central processing unit. Preferably the at least one sensor is used to determine the points in time at which leading and trailing edges of the articles pass a certain point and the central processing unit is used to calculate the lengths of the articles, from these time values. Preferably the central processing unit counts the number of articles that pass said point.

Preferably the method comprises using a cutting member arranged to cut wrapping material extending between the spaced collations of articles so as to disconnect the spaced collations of articles.

Preferably the method comprises using at least one gap measurement sensor to measure gaps between the spaced collations of articles on the second conveyor, calculating the time it will take the measured gap to travel the distance from the at least one gap measurement sensor to the cutting member and controlling the cutting member to cut as gaps between the collations pass the cutting member.

Preferably the method comprises using at least one gap detector sensor to detect whether or not there is gap between collations of articles on the second conveyor immediately prior to the gap passing the cutting station and if the gap is not detected to be in the correct location, then the cutting member is not operated to cut.

Preferably the first and second conveyors of the outlet conveyor are disposed between the applicator and the cutting member.

Preferably the method comprises using a discharge conveyor to transport wrapped and separated collations of articles from the second outlet conveyor.

Preferably the method comprises varying a gap between the first and second conveyors of the outlet conveyor.

Each of the first and/or second conveyors may comprise a pair of opposed spaced apart conveyors for receiving the articles between them. In this case, the method preferably comprises moving the opposed conveyors relative to each other so as to vary their spacing so as to accommodate different sized articles. Preferably the method comprises arranging the opposed conveyors to apply a frictional grip to the articles on the conveyors such that unwanted separation of articles on the conveyors, as the linear velocity of the second conveyor is selectively varied relative to the linear velocity of the first conveyor, is substantially prevented. In this respect, the opposed conveyors are preferably arranged to apply a frictional grip to the articles on the conveyors such that separation between articles, other than the desired separation between longitudinally adjacent articles in adjacent collations that are separated as the linear velocity of the second conveyor is selectively varied relative to the linear velocity of the first conveyor, is substantially prevented.

According to a third aspect of the present invention there is provided a computer program comprising computer readable instructions configured to cause a computer to carry out a method according to the second aspect of the invention.

According to a fourth aspect of the present invention there is provided a computer readable medium carrying a computer program according to the third aspect of the invention.

According to a fifth aspect of the present invention there is provided a computer apparatus for helically wrapping together a collation of articles comprising:

a memory storing processor readable instructions; and a processor arranged to read and execute instructions stored in said memory;

wherein said processor readable instructions comprise instructions arranged to control the computer to carry out a method according to the second aspect of the invention.

Any of the features of any of the above aspects of the invention may be combined.

Specific embodiments of the present invention will now be described, by way of example only, with reference to the accompanying drawings in which.

Figure 1:
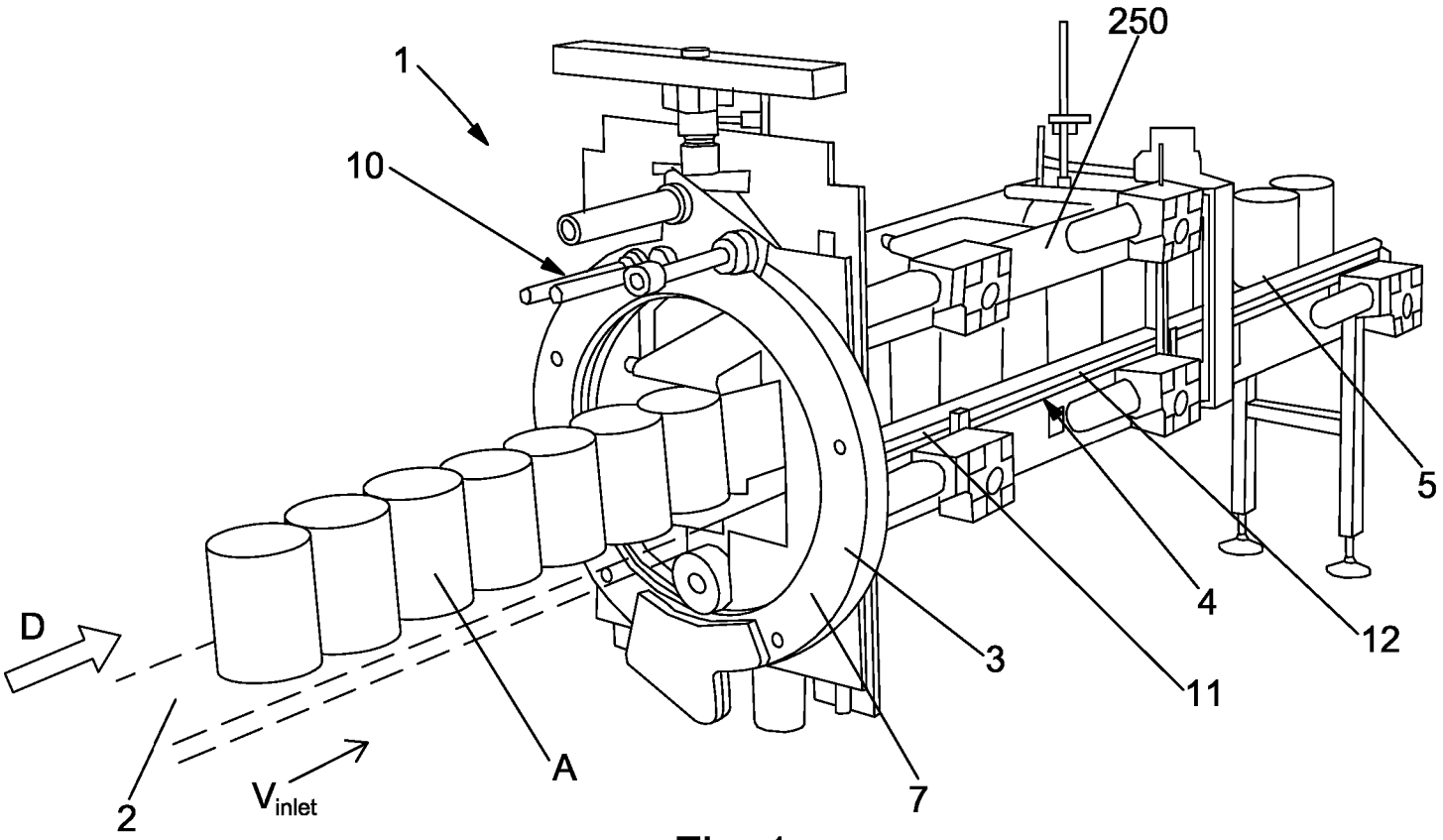
FIG. 1 is a perspective view of a wrapping machine in accordance with an aspect of the present invention (with an inlet conveyor of the wrapping machine shown in dotted outline and wrapping material applied by the machine omitted for illustrative purposes)
Figure 2:
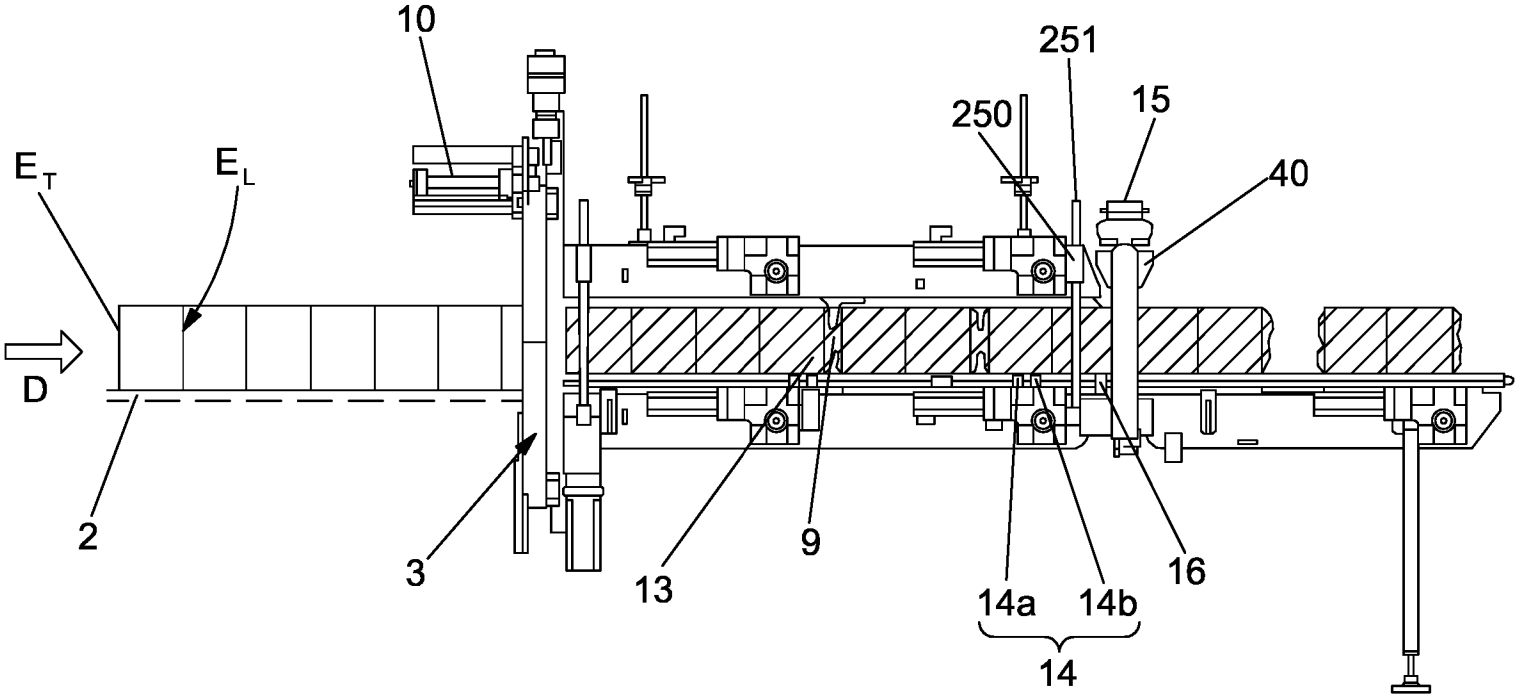
FIG. 2 is a side elevational view of the wrapping machine shown in FIG. 1 (showing the wrapping material applied by the wrapping machine)
Figure 3:
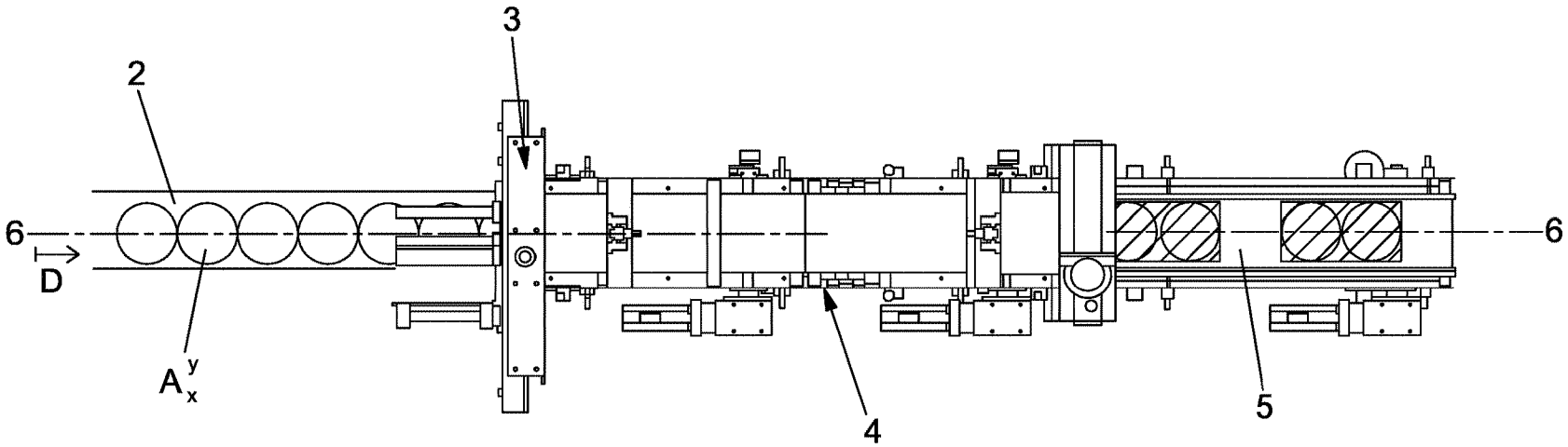
FIG. 3 is a plan view of the wrapping machine shown in FIG. 2.
Figures 4A, 4B:
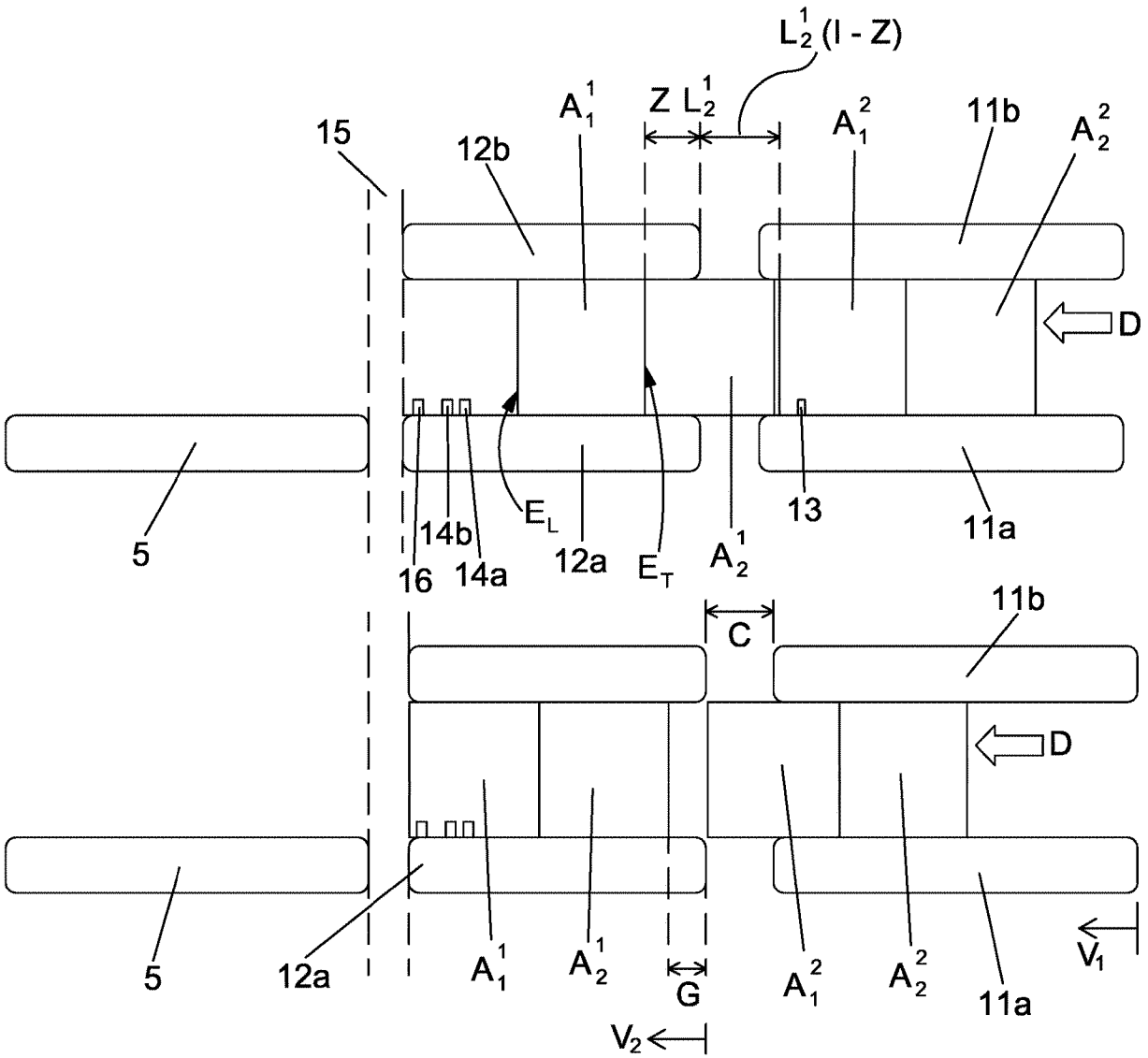
Figure 4C:
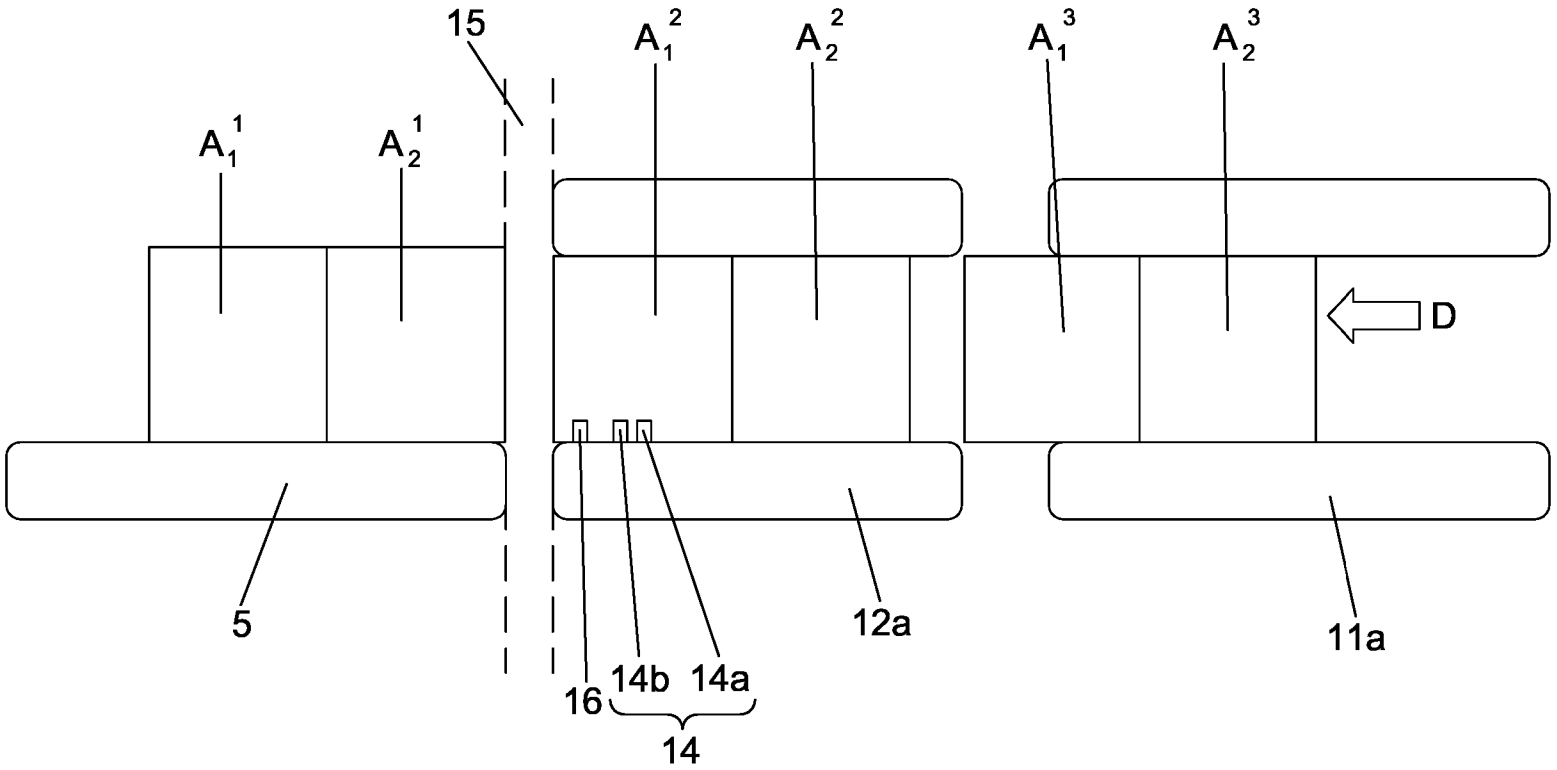
Figure 5A:
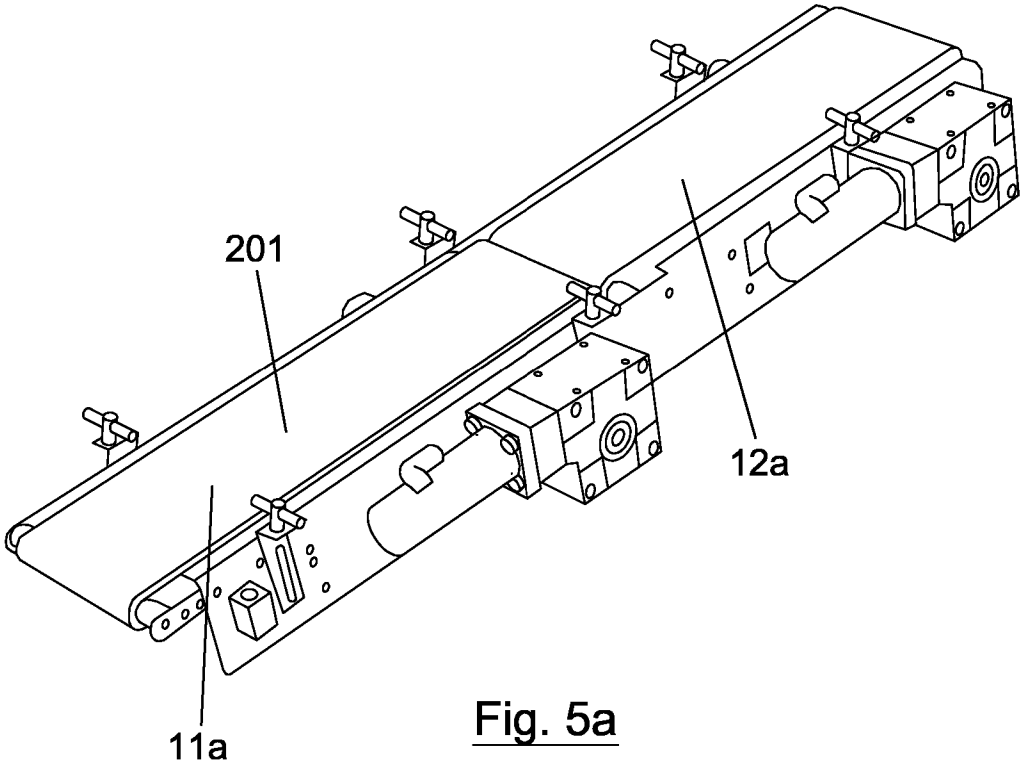
Figure 5B:
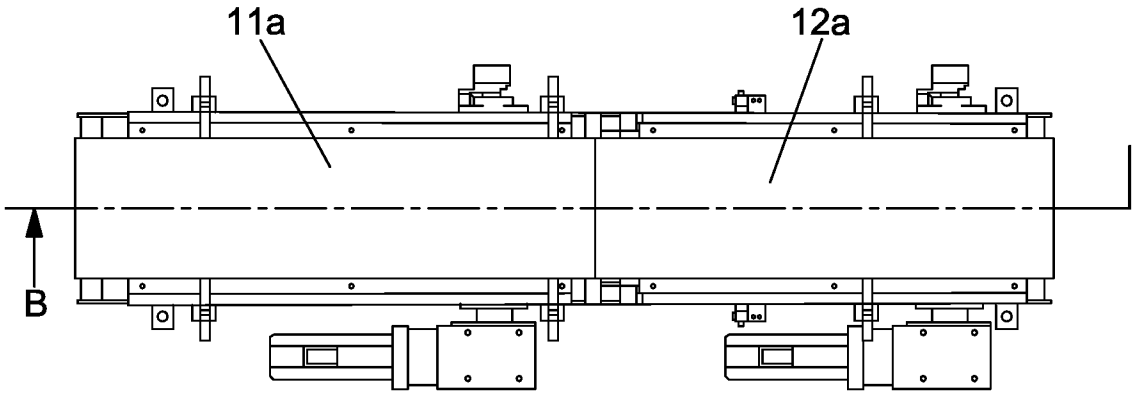

FIGS. 4*a* to *c* show a schematic side elevational view of the wrapping machine of FIGS. 1 to 3 showing, in sequence, the method of operation of an outlet conveyor of the wrapping machine in accordance with an aspect of the present invention (the wrapping material applied by the machine is omitted for illustrative purposes);

FIG. 5*a* shows a perspective view of a lower outlet conveyor of the wrapping machine of FIGS. 1 to 4 where a second conveyor of the lower outlet conveyor is in a first position relative to a first conveyor of the lower outlet conveyor;

FIG. 5*b* shows a plan view of the lower outlet conveyor of FIG. 5*a;*

Figure 5C:
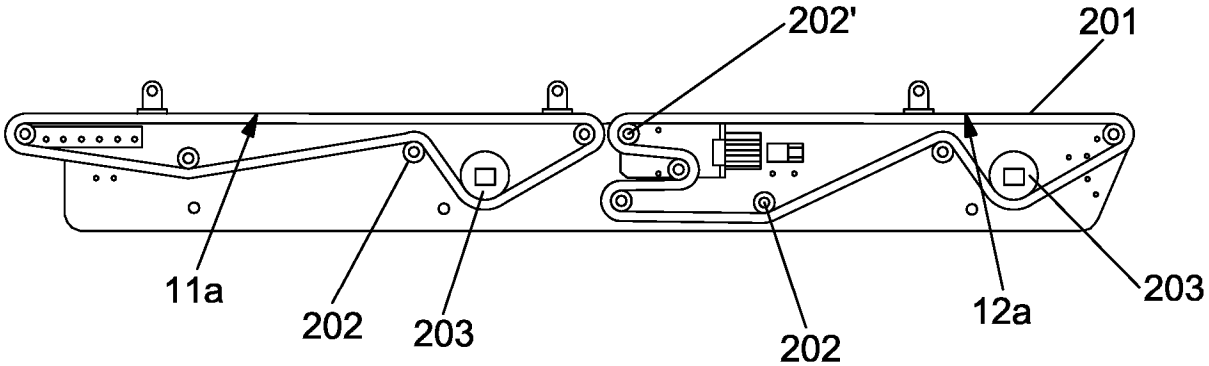

FIG. 5*c* shows a cross-sectional view of the lower outlet conveyor of FIGS. 5*a* and 5*b*, taken along the line B-B in FIG. 5*b;*

Figure 6A:
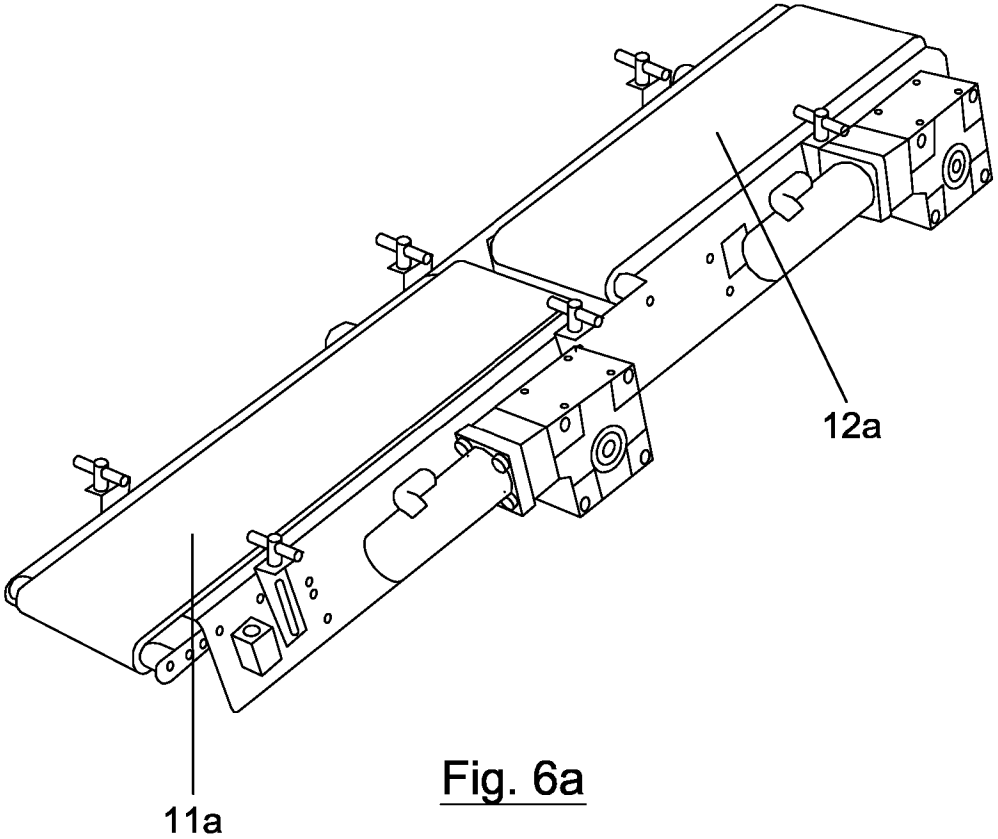
Figure 6B:
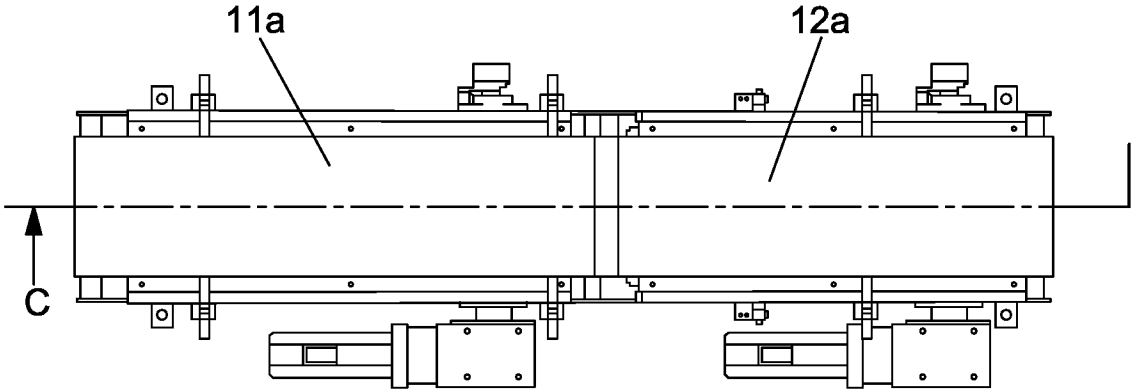

FIG. 6*a* shows view corresponding to that of FIG. 5*a* but where the second conveyor of the lower outlet conveyor is in a second position relative to the first conveyor of the lower outlet conveyor;

FIG. 6*b* shows a plan view of the lower outlet conveyor of FIG. 6*a;*

Figure 6C:
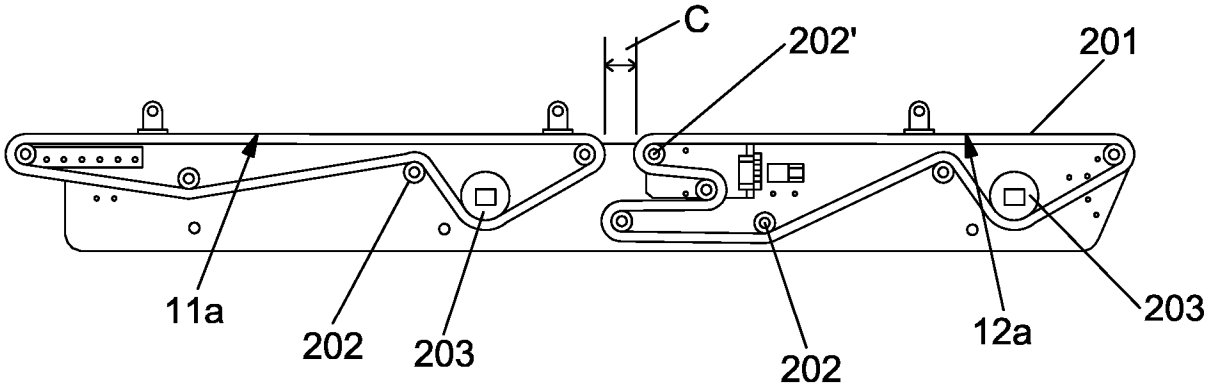

FIG. 6*c* shows a cross-sectional view of the outlet conveyor of FIGS. 6*a* and 6*b*, taken along the line C-C in FIG. 6*b;*

Figure 7:
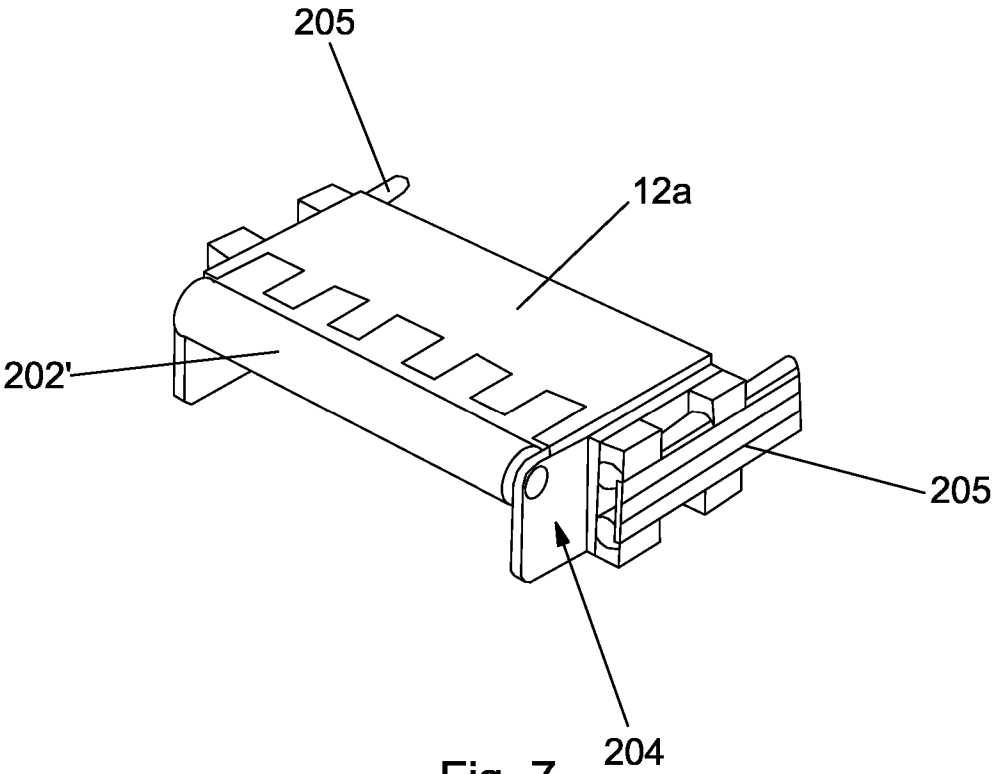
Figure 8:
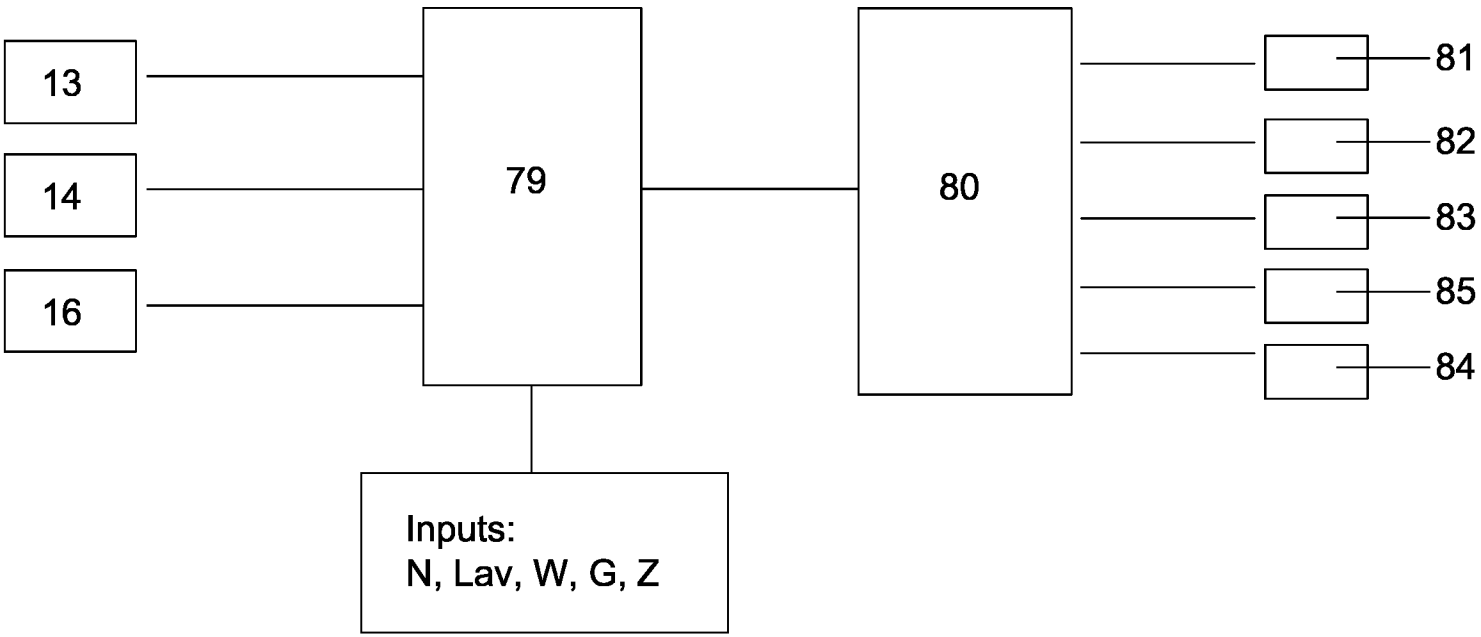

FIG. 7 shows a partial perspective view of an upstream end of the second conveyor of the lower outlet conveyor, with a belt of the conveyor omitted for illustrative purposes, and FIG. 8 shows a schematic view of a control system of the wrapping machine.

Referring to FIGS. 1 to 3 there is shown a wrapping machine 1 in accordance with an aspect of the present invention. The wrapping machine 1 comprises an inlet conveyor 2 arranged to transport unwrapped articles (A) to a wrapping material applicator 3 and an outlet conveyor 4 arranged to transport articles (A) wrapped by the applicator 3 from the applicator 3 to a discharge conveyor 5.

The inlet and outlet conveyors 2, 4 are substantially straight (when viewed from above) and have a common longitudinal axis 6 (see FIG. 3). They are of substantially the same width and are substantially vertically aligned with each other. The inlet and outlet conveyors 2, 4 are spaced apart, in the direction of the common longitudinal axis 6 and the applicator 3 is disposed between them.

The articles (A) are fed in a substantially continuous stream from a store (not shown) to the inlet conveyor 2 by a feeder mechanism in the form of an elongate scroll (not shown). Accordingly, the articles (A) on the inlet conveyor 2 are in a substantially continuous stream. The articles (A) remain in a substantially continuous stream as they are conveyed by the inlet conveyor 2 to the wrapping material applicator 3. The articles (A) are conveyed by the inlet conveyor 2 in a downstream direction (indicated by the arrow D in FIG. 1).

In this respect, the articles on the inlet conveyor 2 that are adjacent to each other in the direction of the longitudinal axis of the inlet conveyor 2 are in contact with each other. There is substantially no separation between articles that are adjacent to each other in the longitudinal direction of the inlet conveyor 2. The articles on the inlet conveyor 2 are not in separate collations, although they may be regarded as forming collations that are in contact with each other.

In the embodiment shown in the Figures, the articles (A) on the inlet conveyor 2 are in single file, i.e. in a single longitudinal row. Alternatively, the articles on the inlet conveyor 2 may be arranged in a plurality of laterally adjacent longitudinal rows. In this case, longitudinally adjacent articles in the same longitudinal row and/or adjacent longitudinal rows may be in contact with each other so as to form a substantially continuous stream. It is preferred that longitudinally adjacent articles in the same longitudinal row are in contact with each other so as to form a substantially continuous stream.

In the embodiment shown in the Figures, the articles (A) are substantially cylindrical cans, with longitudinally adjacent cans having contacting surfaces that are flush with each other such that there is substantially no separation between the contacting surfaces. However it will be appreciated that where the contacting surfaces of adjacent articles are not substantially flush with each other, the articles may be in contact with each other but have surfaces that are partly in contact and partly not in contact.

The articles (A) on the inlet conveyor are unsecured articles, i.e. articles that are not secured together (e.g. by a tray) before they are wrapped by the applicator 3.

The wrapping material applicator 3 incorporates a rotary applicator ring 7. The applicator ring 7 rotates continuously about an axis that is substantially parallel to the common longitudinal axis 6 of the conveyors 2, 4 and dispenses wrapping material 9 (not shown in FIG. 1 for illustrative purposes) from reels 10 disposed at angular intervals around a front face of the applicator ring 7. The reels 10 are attached to articles arriving on the outlet conveyor 4 by streams of wrapping material 9 (shown in cross hatching in FIGS. 2 and 3) which have just been wrapped around the articles. Thus, as the applicator ring 7 rotates, wrapping material 9 is pulled off the reels 10 and wrapped around articles following these articles, as they pass through the applicator ring 7.

The wrapping material 9 on each reel 10 is in the form of a continuous elongate web of thin, stretchable synthetic plastics film such as a polyurethane based material. The film is stretchable in the lateral direction, as well as in the longitudinal direction (as discussed in more detail below). As the articles pass through the ring 7, the wrapping material 9 is stretched and then wrapped in a helical fashion around the articles. The wrapping process continues as the articles progress along the inlet and outlet conveyors 2, 4 such that the wrapping material 9 continues to be wound in a helical fashion around successive upstream articles so as to produce a continuous wrap of articles. The wrapping material 9 is designed to recover from the stretching so that it shrinks tightly around the articles after wrapping.

The articles passing from the inlet conveyor 2 to the outlet conveyor via the wrapping applicator 3 are in a substantially continuous stream. Accordingly, the articles are wrapped in a substantially continuous stream by the wrapping applicator 3. This produces a continuous wrap of a substantially continuous stream of articles (A).

The outlet conveyor 4 comprises a first conveyor 11 adjacent to the wrapping applicator 3 in the downstream direction and a second conveyor 12 adjacent to the first conveyor 11 in the downstream direction.

The first conveyor 11 comprises a lower conveyor 11*a* and an upper conveyor 11*b* disposed above the lower conveyor 11*a* (see FIGS. 4*a* to *c*). The upper and lower conveyors 11*a*, 11*b* are substantially aligned in the longitudinal direction. In this respect, upstream and downstream ends of the upper conveyor 11*b* are substantially aligned with upstream and downstream ends of the lower conveyor 11*a* respectively in the longitudinal direction. The upper and lower conveyors 11*a*, 11*b* are substantially straight and are substantially aligned in the lateral direction such that they have a common longitudinal axis. The upper and lower conveyors 11*a*, 11*b* have substantially the same width.

Similarly, the second conveyor 12 comprises a lower conveyor 12*a* and an upper conveyor 12*b* disposed above the lower conveyor 12*a* (see FIGS. 4*a* to *c*). The upper and lower conveyors 12*a*, 12*b* are substantially aligned in the longitudinal direction. In this respect, upstream and downstream ends of the upper conveyor 12*b* are substantially aligned with upstream and downstream ends of the lower conveyor 12*a* respectively in the longitudinal direction. The upper and lower conveyors 12*a*, 12*b* are substantially straight and are substantially aligned in the lateral direction such that they have a common longitudinal axis. The upper and lower conveyors 12*a*, 12*b* have substantially the same width.

The upper and lower conveyors 11*a*, 11*b* of the first conveyor 11 run at substantially the same linear velocity ($V_1$). Similarly, the upper and lower conveyors 12*a*, 12*b* of the second conveyor 12 run at substantially the same linear velocity ($V_2$) (as discussed in more detail below). The linear velocities of the first and second conveyors $V_1$, $V_2$ are in the same direction, such that articles on the conveyors are conveyed in the direction D.

The first and second outlet conveyors 11, 12 are spaced apart by a gap of length C in the longitudinal direction (see FIG. 4*b*). In this respect, the upstream end of the second upper conveyor 12*b* is spaced from the downstream end of the first upper conveyor 11*b* by the gap C. Similarly, the upstream end of the second lower conveyor 12*a* is spaced from the downstream end of the first lower conveyor 11*a* by the gap C.

The discharge conveyor 5 is longitudinally spaced from the second conveyor 12 of the outlet conveyor 4. The discharge conveyor 5 is arranged to receive wrapped and separated collations of articles from the second outlet conveyor 12 and to transport these collations to a desired location, e.g. to a store. The discharge conveyor 5 is substantially vertically aligned with the lower conveyor 12*a* of the second conveyor 12.

A cutting station 15 is located between the second conveyor 12 and the discharge conveyor 5. The cutting station 15 has a cutting member in the form of a reciprocating blade 40 (see FIG. 2) that is arranged to cut wrapping material 9 extending between spaced collations of articles (discussed in more detail below). The cutting member may be of any suitable type, for example a hot wire.

Referring to FIG. 8, the inlet conveyor 2, the first and second conveyors 11, 12 of the outlet conveyor 4 and the discharge conveyor 5 are actuated by respective actuators 83, 81, 82, 84. The cutting blade 40 of the cutting station 15 is actuated by an actuator 85. Each of these actuators 81-85 is controlled by a controller 80.

A first sensor 13 (see FIG. 2) is arranged to detect when an article passes the sensor 13 and to determine the length of the article (as discussed in more detail below). The first sensor 13 is adjacent to and upstream of the downstream end of the first conveyor 11. The first sensor 13 is provided on one lateral side of the first lower conveyor 11*a* of the outlet conveyor 4, attached to a frame on which the first conveyor 11 is rotatably supported. The first sensor 13 is an optical sensor.

A gap measuring sensor array 14 is arranged to measure a longitudinal gap between longitudinally adjacent collations of articles on the second conveyor 12 (as discussed in more detail below). The gap measuring sensor array 14 is adjacent to and upstream of the cutting station 15. The gap measuring sensor array 14 comprises first and second sensors 14*a*, 14*b*. The second sensor 14*b* is adjacent to and spaced from the first sensor 14*a* in the downstream longitudinal direction 6. The first and second sensors 14*a*, 14*b* are provided on a lateral side of the second lower conveyor 12*a*, attached to a frame on which the second conveyor 12 is rotatably supported. The first and second sensors 14*a*, 14*b* are optical sensors.

A gap detector sensor 16 is arranged to detect whether or not there is a longitudinal gap between longitudinally adjacent collations on the second conveyor 12 immediately prior to the gap passing the cutting station 15 (as discussed in more detail below). The gap detector sensor 16 is immediately adjacent to, and upstream of, the cutting station 15. The gap detector sensor 16 is an optical sensor.

Referring to FIG. 8, the first sensor 13, gap measuring sensor array 14 and gap detector sensor 16 are each connected to a central processing unit 79, which is connected to a controller 80. The controller 80 is connected to the respective actuators 83, 81, 82, 84 of the inlet conveyor 2, the first and second conveyors 11, 12 of the outlet conveyor 4 and the discharge conveyor 5. The central processing unit 79 is also arranged to receive input values of the number of articles N to be wrapped per unit time, the average anticipated length of the articles to be wrapped $L_{av}$, the number of articles in each collation $W^y$ (where 'y' corresponds the collation number), the desired length of gap G between each collation and the value 'z' (see below).

Based on the signals received from the sensors 13, 14, 16, the central processing unit 79 operates the controller 80 to control the linear velocities of the inlet conveyor 2, the first and second conveyors 11, 12 of the outlet conveyor 4 and the discharge conveyor 5 by control of their respective actuators 83, 81, 82, 84. In addition, the controller 80 controls the timing of the cutting station 15.

As will now be described, the linear velocity of the second outlet conveyor 12 is selectively varied relative to the linear velocity of the first outlet conveyor 11 (by the central processing unit 79 and the controller 80) so as to separate the continuous stream of wrapped articles passing along the outlet conveyor 4 into separate, longitudinally spaced, collations of articles.

Referring now to figures to 4*a* to 4*c*, there is shown a schematic side view of the first and second conveyors 11, 12 of the outlet conveyor 4, the cutting station 15 and the discharge conveyor 5. FIGS. 4*a* to *c* show the sequential steps of a method, in accordance with an aspect of the invention, of selectively varying the linear velocity of the second outlet conveyor 12 relative to the linear velocity of the first outlet conveyor 11 so as to separate the continuous stream of wrapped articles passing along the outlet conveyor 4 into separate, longitudinally spaced, collations of articles.

It will be appreciated that the articles shown are a selection of articles passing along the conveyor, with articles upstream and downstream of those shown omitted from the figures for illustrative purposes.

Referring to FIG. 4*a*, each of the articles shown is labelled '$A_x^y$' where 'x' corresponds to the upstream position of the article in the respective collation and 'y' corresponds to the upstream position of the collation with reference to the collations of articles shown in FIG. 4*a* (i.e. the most downstream article in collation 'y' is labelled $A_1^y$, the adjacent upstream article in the collation is labelled $A_2^y$, etc and $A_x^1$ refers to article x of the most downstream collation shown in FIG. 4*a*, $A_x^2$ refers to the next upstream collation, $A_x^2$ refers to the next collation upstream of $A_x^2$, etc).

The collations of articles each consist of a pre-designated number '$W^y$' of articles (where 'y' again corresponds to the upstream position of the collation with reference to the collations of articles shown in FIG. 4*a*). In the currently described embodiment $W^y=2$ (for each value of y), i.e. each collation consists of two articles. Accordingly $A_2^y=A_W^y$ (for each value of y). However, it will be appreciated that the number of articles $W^y$ in each collation may be varied (i.e. the value of $W^y$ may vary as the value of y varies). The value of $W^y$ is manually input to the central processing unit 79. In addition, the value $W^y$ can be varied during operation of the machine so as to vary the number of articles in each collation without having to stop and start the machine.

The inlet conveyor 2 is set, by the controller 80, to run at a linear velocity $V_{inlet}$. The linear velocity $V_{inlet}$ is calculated by the central processing unit 79 in dependence on the number of articles N to be wrapped per unit time (e.g. per minute) and the average anticipated length of each article to be wrapped $L_{av}$. The values of N and $L_{av}$ are manually input to the central processing unit 79 prior to operation of the wrapping machine. It will be appreciated that the values of N and $L_{av}$ can be varied as desired.

Specifically:

$$V_{inlet}=N\times L_{av} \quad (1)$$

Alternatively, the linear velocity of the inlet conveyor $V_{inlet}$ could be varied to take into account varying lengths of articles, in order to provide the required number of articles per unit time (N), i.e. the actual lengths of the articles are used instead of the average anticipated lengths $L_{av}$. This could be achieved by using a sensor arrangement to measure the lengths of the articles on the inlet conveyor to vary the linear velocity of the inlet conveyor $V_{inlet}$ so as order to provide the required number of articles per unit time (N) conveyed along the inlet conveyor. The sensor arrangement would preferably measure the lengths of articles on the inlet conveyor. Alternatively, the measurement of lengths of articles on the first outlet conveyor 11, by the first sensor 13 (see below), could be used. The measured lengths of the articles would be passed from the sensor to the central processing unit 79, which would then calculate the value of $V_{inlet}$ accordingly.

The value of $V_{inlet}$ is then passed from the central processing unit 79 to the controller 80, which controls the inlet conveyor actuator 83 so that the linear velocity of the inlet conveyor 2 equals this calculated value.

The linear velocity $V_1$ of the first outlet conveyor 11 is set, by the central processing unit 79 and controller 80 (which controls the respective first outlet conveyor actuator 81), such that $V_1$ is substantially equal to $V_{inlet}$ at all times.

In this respect, the linear velocities of the upper and lower conveyors 11*a*, 11*b* of the first conveyor 11 are set to be substantially the same at all times and are equal to $V_1$. The linear velocities of the inlet conveyor 2 and of the first and second outlet conveyors 11, 12 are in the same direction (see the arrows labelled $V_{inlet}$, $V_1$ and $V_2$) and are such that articles $A_x^y$ on the conveyors 2, 4 are conveyed in the direction of the arrow D.

The linear velocity $V_2$ of the second outlet conveyor 12 is set, by the central processing unit 79 and controller 80 (which controls the respective second outlet conveyor actuator 82). In this respect, the linear velocities of the upper and lower conveyors 12*a*, 12*b* of the second conveyor 12 are set to be substantially the same at all times and are equal to $V_2$.

The linear velocity of the second outlet conveyor 12 relative to the linear velocity of the first outlet conveyor 11 is selectively varied so as to separate the continuous stream of wrapped articles $A_x^y$ on the outlet conveyor 4 into separate, longitudinally spaced, collations of articles of a desired number $W^y$ (in this case W=2) by carrying out the following sequence of steps:

1) the linear velocity $V_2$ of the second conveyor 12 is set to substantially the same as the linear velocity of the first conveyor $V_1$, whereby a collation of articles ($A_1^1$ to $A_2^1$) is at least partially received by the second outlet conveyor 12 from the first outlet conveyor 11;
2) once a proportion 'z' (where $0<z\leq 1$) of the length $L_2^1$ of the last article $A_2^1$ of the collation is received by the second conveyor 12, the linear velocity $V_2$ of the second outlet conveyor 12 is increased to a value $V_{2inc}$;
3) the second conveyor 12 is maintained at the value $V_{2inc}$ until the first article $A_1^2$ of the next upstream collation reaches the upstream end of the second outlet conveyor 12, so as to produce a gap of a desired length G between the last article $A_2^1$ of the collation and the first article $A_1^2$ of the next upstream collation at this point in time, following which the sequence returns to the first step (i.e. at the point at which the first article $A_1^2$ of the next upstream collation reaches the upstream end of the second outlet conveyor 12, the linear velocity $V_2$ of the second outlet conveyor 12 is decreased to be substantially equal to that of the first outlet conveyor $V_1$).

The above three steps are then repeated in sequence for each collation of articles $A_x^y$ (i.e. where x varies from 1 to W, for each value of y) so as to separate the articles $A_x^y$ into separate collations spaced apart by a gap G.

The point in time immediately after step (2) commences is shown in FIG. 4*a*. The point in time at which step (3) passes to step (1) is shown in FIG. 4*b*.

During the next step (1), the next upstream article $A_1^2$ is received by the second conveyor 12 and is conveyed by the second outlet conveyor 12 at the linear velocity of the second conveyor $V_2$, which is substantially equal to that of the first conveyor $V_1$ (during this step). The article $A_1^2$ is in contact with both the first and second outlet conveyors, which are both at linear velocity $V_1$. Accordingly, the gap G between the articles $A_2^1$ and $A_1^2$ (i.e. between the adjacent collations) is maintained substantially constant during this step.

During the next step (2), the articles $A_2^1$ and $A_1^2$ (as well as $A_2^2$) are both conveyed by the second conveyor at linear velocity $V_{2inc}$. Accordingly, the gap G between these articles also remains substantially constant during this step.

The gap G is the longitudinal gap between the trailing edge $E_T$ (the upstream edge) of the article $A_2^1$ and the leading edge $E_L$ (the downstream edge) of the article $A_1^2$.

Throughout each of the above three steps, the linear velocity $V_1$ of the first outlet conveyor 11 is maintained substantially constant. Accordingly, the relative linear velocity of the second outlet conveyor 12 relative to that of the first outlet conveyor 11 is selectively varied by varying the linear velocity $V_2$ of the second outlet conveyor 12.

The changes in the linear velocity of the second outlet conveyor $V_2$ from $V_1$ to $V_{2inc}$ and back again are step changes in velocity, i.e. these changes in velocity are substantially instantaneous. The value of $V_{2inc}$ is calculated by the central processing unit 79, as will now be described with reference to FIGS. 4*a* to 4*c*.

As an article $A_x^y$ passes the first sensor 13, the sensor detects the times $TL_x^y$, $TT_x^y$ at which the leading and trailing edges $E_L$, $E_T$ of the article $A_x^y$ passes the sensor 13 respectively, and these time values are passed to the central processing unit 79. The central processing unit 79 logs the time values $TL_x^y$, $TT_x^y$ in a memory and calculates the length $L_x^y$ of the article $A_x^y$ (in the longitudinal direction) from the linear velocity $V_1$ of the first outlet conveyor 11 using the equation:

$$L_x^y=V_1\times(TT_x^y-TL_x^y) \quad (2)$$

In the described embodiment, each article $A_x^y$ has substantially the same length $L_x^y$. However, it will be appreciated that the articles may have different lengths (as discussed in more detail below).

In FIG. 4*a* (i.e. where W=2), the second article of the first collation $A_2^1$ has been received by the second outlet conveyor 12 by the distance $z^*L_2^1$ (for ease of illustration, the labelling of these distances in FIG. 4*a* ignores the infinitesimal gap created in FIG. 4*a* between the articles $A_2^1$ and $A_1^2$). The sequence then passes to step (2), in which the linear velocity $V_2$ of the second conveyor 12 is increased to a value $V_{2inc}$. Since $V_{2inc}$ is greater than $V_1$, the article $A_2^1$ then begins to separate from the next upstream article $A_1^2$ (which is the first article of the next upstream collation), creating a gap between the articles in the longitudinal direction.

At the point in time that $V_2$ is increased to $V_{2inc}$ (which is the position immediately before that shown in FIG. 4*a*—i.e. where $A_2^1$ are in contact $A_1^2$) the distance between the leading edge $E_L$ of the article $A_1^2$ and the upstream end of the second outlet conveyor 12 is equal to $L_2^1*(1-z)$ (since at this time $A_2^1$ and $A_1^2$ are in contact).

The time taken for the leading edge $E_L$ of article $A_1^2$ to reach the upstream end of the second outlet conveyor 12, while travelling at linear velocity $V_1$ is also the time $T_{V2inc}$ that $V_2$ is maintained at $V_{2inc}$ and is calculated from:

$$T_{V2inc} = \frac{L_2^1 \times (1-z)}{V_1} \tag{3}$$

This can be expressed more generally as:

$$T_{V2inc} = \frac{L_W^n \times (1-z)}{V_1} \tag{4}$$

(for collation 'n')

During the period of time that $V_2=V_{2inc}$ the length of the gap (in the longitudinal direction) increases linearly from 0 to a value G (see FIGS. 4*a* and 4*b*).

In order to produce a gap of the desired length G between the articles $A_2^1$ and $A_1^2$ in the time $T_{V2inc}$, the article $A_2^1$ must travel the distance $L_2^1$ (1−Z)+G in the time $T_{V2inc}$.

Accordingly, using the equation speed=distance/time (which assumes a constant speed), the value of $V_{2inc}$ necessary to produce a gap of the desired length G between the article $A_2^1$ and the next upstream article $A_1^2$ at the point at which the next upstream article $A_1^2$ reaches the upstream end of the second outlet conveyor 12 is calculated by the central processing unit 79 using the equation:

$$T_{2inc} = \frac{V_1(L_2^1(1-z)+G)}{L_2^1(1-z)} \tag{5}$$

This simplifies to:

$$V_{2inc} = V_1 * \left(1 + \frac{G}{L_2^1(1-z)}\right) \tag{6}$$

This can be expressed more generally as:

$$V_{2inc} = V_1 * \left(1 + \frac{G}{L_W^n(1-z)}\right) \tag{7}$$

This assumes that the increase of $V_1$ to $V_{2\ inc}$ is a step change in velocity. If the increase was not a step change then a modified version of this equation could be used in which the increase in velocity over time is taken into account by using standard calculus techniques.

The central processing unit 79 passes the calculated value of $V_{2inc}$ to the controller 80 which controls the linear velocity of the second outlet conveyor 12 accordingly.

As stated above, $V_2$ is held at $V_{2inc}$ for time $T_{V2inc}$. At the end of this period of time, the leading edge $E_L$ of the first article of the next collation $A_1^2$ has just reached the upstream end of the second outlet conveyor 12. The sequence then returns to steps (1) and (2), in which the linear velocity $V_2$ of the second conveyor 12 is set to substantially the same as the linear velocity of the first conveyor $V_1$, until a proportion 'z' (where $0<z\leq1$) of the length $L_2^2$ of the last article $A_2^2$ of the next collation is received by the second conveyor 12.

The distance $L_{Total}$ that that articles in the next collation must travel until the proportion 'z' (where $0<z\leq1$) of the length $L_2^2$ of the last article $A_2^2$ of the next collation is received by the second conveyor 12 is calculated by:

$$L_{Total}=L_1^2+(z\times L_2^2) \tag{8}$$

Therefore, using the equation time=distance/speed, the time $T_{V1}$ at which V2=V1 (for this next collation) is calculated by:

$$T_{V1} = \frac{L_1^2 + (z \times L_2^2)}{V_1} \tag{9}$$

This can be expressed more generally as:

$$T_{V1} = \frac{L_1^{n+1} + L_2^{n+1} + \ldots\ L_{W-1}^{n+1} + (z \times L_W^{n+1})}{V_1} \tag{10}$$

It will be appreciated that for each collation (n), the time $T_{V1}$ at which V2=V1 (for this collation) is calculated by:

$$T_{V1} = \frac{L_1^n + L_2^n + \ldots\ L_{W-1}^n + (z \times L_W^n)}{V_1} \tag{11}$$

Accordingly, for each collation $V_2=V_1$ for $T_{V1}$ then $V_2=V_{2inc}$ for $T_{V2}$, then this is repeated. By repeating the above sequence of steps for each collation, the articles $A_x^y$ passing along the outlet conveyor 4 are separated into longitudinally spaced collations of the number of articles $W^y$, where the collations are spaced from each other by the longitudinal gap G.

The above calculations assume that the articles on the first outlet conveyor 11 are in a substantially continuous stream. In practice, it may be the case that, due to external factors, articles on the inlet conveyor are disturbed such that they are not in a substantially continuous stream. Accordingly, the first sensor 13 (and the central processing unit 79) is arranged to determine the positions of articles and to determine if there is any spacing between articles on the first outlet conveyor 11. If there is any spacing then the first sensor 13 sends a signal to the central processing unit 79 which adapts the above calculations accordingly and/or stops the machine.

In the described embodiment z=⅓. The value of z is manually input to the central processing unit 79 and can be varied as desired. The value of 'z' is chosen so that the frictional contact between the second conveyor 12 and the last article in the collation $A_{W^y}^y$ is sufficient that when, during step 2, the linear velocity of the second conveyor is increased to $V_{inc}$, the article $A_W^y$ is conveyed by the second conveyor 12 at this linear velocity.

The value of G is manually input to the central processing unit 79 and can be varied as desired. In the described embodiment, the value of G is the same for each adjacent pairs of collations. However, it will be appreciated that the value of G may be varied between adjacent pairs of collations if desired. The value of G can be varied during operation of the machine so as to vary the size of the gap without having to stop and start the machine.

Because the calculated value of $V_{2inc}$ takes into account the lengths of the articles, the value of $V_{2inc}$ is automatically adjusted if there is a change in length of the articles. Accordingly there is no need to stop and recalibrate the machine if the lengths of the articles vary.

As stated above, the first sensor 13 is used to measure the lengths of the articles. The values of $V_2$, $Tv_{2inc}$ and $T_{V1}$ (and possibly $V_1$) are calculated in dependence on the measured lengths of the articles. Accordingly, since the articles on the first outlet conveyor 11 are in a substantially continuous stream, once the position of the first article in the entire stream, i.e. when the machine is first switched on, is known it is theoretically not necessary for the positions of the following articles in the stream to be measured. It is only required that their lengths are determined. The first sensor 13 is arranged to determine when the first article in the entire stream passes the first sensor 13 and this timing signal is passed to the central processing unit 79, which then initiates the above sequence of steps accordingly.

If the lengths of the articles being fed onto the inlet conveyor were known, e.g. if they are all a constant, known length, then it would not be necessary for the apparatus to have a sensor 13 that measures the lengths of the articles. However, such an apparatus would not be able to automatically account for varying lengths of articles.

In addition, if the initial position of the first article in the entire stream was known before the machine is operated, and all the lengths of the articles are known (e.g. if they were constant), then it is conceivable that the machine would not require a sensor 13 to determine when the first article in the entire stream passes the first sensor 13 or to determine the lengths of the articles. Such a machine would only use a controller to vary the linear velocity of the second conveyor as described above. However, such an apparatus would not be able to automatically account for varying lengths of articles and would not be able to account for any disturbance of the articles along the conveyors.

As the collations are separated from each other, the wrapping material 9 that is continuously wrapped around the articles is stretched between the collations (see FIG. 2). Accordingly, it is necessary that the wrapping material 9 is of a material that is sufficiently stretchable in the longitudinal direction (as well as being sufficient stretchable in the lateral direction to allow for the helical wrapping).

The size of the gap between adjacent collations may not exactly equal the calculated value of G due to external factors, such as the resilience of the wrapping material 9. Accordingly, it is necessary to measure the gap between adjacent collations of articles.

The first and second sensors 14*a*, 14*b* of the gap measuring sensor array 14 are arranged to measure the gap between the adjacent collations of articles on the second outlet conveyor 12, i.e. the gap between the trailing edge $E_T$ of the last article in a collation $A_W^n$ and the leading edge $E_L$ of the first article in the next collation $A_1^{n+1}$. This may be done, for example, by logging the times ($T_1$, $T_2$) at which the trailing edge of the last article in a collation $A_W^n$ and the leading edge of the first article in the next collation $A_1^{n+1}$ pass the sensors and using this in conjunction with the known linear velocity of the second conveyor to calculate the gap (i.e. using gap length=$(T_2-T_1)*V_2$)).

The value of the measured gap $G_m$ between each collation is passed from the gap measuring sensor array 14 to the central processing unit 79, which logs these values in its memory. In addition, since the distance from the gap measuring sensor array 14, to the cutting station 15, is known, the location of the gap is known at this point in time. The central processing unit 79 calculates the time it will take the measured gap to travel the distance from the gap measuring sensor array 14 to the cutting station 15 when travelling at the velocity $V_2$. The central processing unit 79 is arranged to take any variation in $V_2$ during the time the gap takes to reach the cutting station 15 into account (e.g. if the $V_2$ is increased from the $V_1$ to $V_{2inc}$ or vice versa) using standard calculus techniques, so as to calculate when the measured gap will reach the cutting station 15.

The central processing unit 79 operates the cutting blade 40 of the cutting station 15, via the controller 80 and respective actuator 85, so that the cutting blade 40 moves to cut the wrapping material 9 extending between adjacent collations when the measured gap between the collations passes the cutting blade 40.

As a safety feature, the gap detector sensor 16, which is immediately adjacent to and upstream of the cutting station 15, is arranged to detect whether or not the actual position of the gap corresponds to that of the calculated position of the gap immediately prior to the gap passing the cutting station 15. If the gap is not detected to be in the correct location, then the cutting blade 40 is not operated. This prevents the cutting blade 40 from inadvertently being operated when an article is passing the blade, as opposed to a gap. This prevents damage to the articles.

The separated collations of articles then pass from the cutting station 15 to the discharge conveyor 5.

As stated above, the first and second outlet conveyors 11, 12 are spaced apart by a gap of length C in the longitudinal direction 6. Referring now to FIGS. 5 and 6 there is shown the lower conveyors 11*a*, 12*a* of the first and second outlet conveyors. Each of the first and second lower conveyors 12*a*, 12*b* comprises a conveyor belt 201 passed around a plurality of passive rollers 202 and a toothed wheel 203 that is driven by the respective actuator 81, 82.

The second lower conveyor 12*a* is movable in the longitudinal direction 6 to vary the length of the gap C between the first and second lower conveyors 11*a*, 12*a*. In this respect, the roller 202' of the second lower conveyor 12*a* that is adjacent to the first lower conveyor 11 is movable in the longitudinal direction 6, towards and away from the first conveyor 11*a* to vary the size of the gap C between the conveyors 11*a*, 12*a*. The roller 202' is rotatably mounted on a carriage 204 that is slidably mounted on a pair of laterally opposed guide tracks 205 that extend in the longitudinal direction 6 (see FIG. 7).

The second lower conveyor 12*a* is movable in the longitudinal direction 6 from a first position, in which the size of the gap is a minimum, as shown in FIGS. 5*a* to 5*c* (the gap is actually zero in this case) and a second position, in which the size of the gap is a maximum, as shown in FIGS. 6*a* to 6*c*.

The position of the roller 202' may be manually varied. Alternatively, or additionally, the controller 80 may be connected to an actuator (e.g. a motor) that moves the carriage 204 along the guide tracks 205 so as to vary the size of the gap C. Accordingly, input commands may be provided to the central processing unit 79 so as to vary the size of the gap C.

The upper conveyors 11*b*, 12*b* have the same arrangement as the lower conveyors, with the upper conveyor 12*b* of the second conveyor being movable with the lower conveyor 12*a*, to vary the size of the gap G.

The length of the gap C is selected based on the length $L_x^y$ of the articles $A_x^y$, the velocities of the first and second outlet conveyors 11, 12 and the amount of frictional grip imparted by the first and second outlet conveyors 11, 12. The length of the gap C may be varied as desired (see below).

The upper and lower conveyors 11*a*, 11*b*, 12*a*, 12*b* of the first and second conveyors 11, 12 are arranged such they apply a frictional grip to the articles on the respective conveyors so as to prevent unwanted separation of articles on the conveyors as the collations of articles are separated according to the above method.

The first and second outlet conveyors 11, 12 are arranged such that the separation (i.e. the height) between the upper and lower conveyors (11*a*, 12*a*, 11*b*, 12*b*) can be varied. In this respect, the upper conveyors 11*b*, 12*b* are mounted on a carriage 250 that is slidably mounted to a vertical frame 251 (see FIG. 2). This allows the separation of the upper and lower conveyors (11*a*, 12*a*, 11*b*, 12*b*) to be adjusted so as to accommodate articles of different heights and to apply the desired grip on the articles to prevent unwanted separation of articles on the conveyors. In this respect, the upper and lower conveyors are arranged to apply a frictional grip to the articles on the conveyors such that separation between articles, other than the desired separation between longitudinally adjacent articles in adjacent collations that are separated as the linear velocity of the second conveyor 12 is selectively varied relative to the linear velocity of the first conveyor 11, is substantially prevented.

Where the articles on the inlet conveyor 2 are arranged in a plurality of laterally adjacent longitudinal rows, the articles form a plurality of longitudinally adjacent lateral rows each of a plurality of articles. In this case, the references to '$A_x^y$' refer to the respective lateral rows of articles and references to the word article or articles refers, where appropriate, to a lateral row or lateral rows of articles respectively. For example, the value N refers to the number of lateral rows of articles to be wrapped per unit time and $L_{av}$ refers to the average anticipated longitudinal length of each lateral row. In addition, the value $W^y$ refers to the desired number of lateral rows in each collation (y). The articles on the outlet conveyor 2 are separated into collations of articles having corresponding numbers of longitudinal rows of articles (as the articles on the inlet conveyor). The articles within each lateral row are preferably substantially the same size and shape.

The wrapping machine of the described embodiment is advantageous in that the articles can be separated into separate collations of articles on the outlet conveyor 4, i.e. after they have been wrapped by the wrapping applicator 3. This means that the articles do not have to be separated into separate collations of articles on the inlet conveyor, thereby allowing the articles to be fed from the inlet conveyor 2 to the applicator 3 in a substantially continuous stream, so that the articles are wrapped in a substantially continuous stream. This produces a substantial saving in wrapping material 9 since there are substantially no gaps between successive collations of articles that are "wrapped" (as in known wrapping machines). In addition, since the articles are in a substantially continuous stream, they are less susceptible to being twisted or toppled as they approach the applicator 3 on the inlet conveyor 2 and when being wrapped by the applicator 3. This results in a tighter and more efficient wrapping of the articles.

Furthermore, this removes the need for a bulky and expensive reciprocating pusher arrangement which may otherwise be needed in order to separate the articles into separate collations of articles.

In the above equations, no units have been given. It will be appreciated that any system of units could be used, as long as the units are used consistently. For example, where G is in meters (m), N is the number of articles to be wrapped per second, $L_{av}$ is in meters (m) and $TL_x^y$, $TT_x^y$ are in seconds, the value of $V_{2inc}$ will be in meters per second (m/s).

A suitable computer program comprising computer readable instructions configured to cause a computer to carry out the method of the invention may be used. A computer readable medium carrying the computer program may be used.

It will be appreciated that numerous modifications to the above described design may be made without departing from the scope of the invention as defined in the appended claims.

For example, in the described embodiment the linear velocity of the second conveyor relative to that of the first conveyor is varied by keeping the linear velocity $V_1$ linear velocity $V_2$ of the second conveyor 12. Alternatively, the linear velocity $V_2$ of the second conveyor 12 may be maintained substantially constant, with the linear velocity $V_1$ of the first conveyor 11 varied.

Alternatively, the linear velocities of both the first and second conveyors may be varied. In this respect, if the linear velocity of the inlet conveyor $V_{inlet}$ was varied to take into account varying lengths of articles, in order to provide the required number of articles per unit time (N) (see above) then, since $V_1$ is substantially equal to $V_{inlet}$ at all times, $V_1$ would vary with time accordingly. The above equations would then need to be modified to take into account this variation of $V_1$ with time using, for example, standard calculus techniques.

In the described embodiment, the articles on the inlet conveyor 2 are in a substantially continuous stream. Alternatively, the articles on the inlet conveyor 2 may be spaced from each other in the longitudinal direction. Although this, to some extent, negates some of the advantages of the invention in that the articles are more prone to twisting and toppling when they are wrapped and are packaged less tightly than when the articles on the inlet conveyor 2 are in a substantially continuous stream, the invention is still advantageous in that it does not require a bulky and costly push rod arrangement upstream of the inlet conveyor 2 so as to separate the articles into collations before they reach the applicator 3. In this case, the first sensor 13 and central processing unit 79 would be arranged to determine the spacing between the articles on the first outlet conveyor 11 and to adapt the above calculations accordingly. It is preferred that the articles on the inlet conveyor 2 are in a substantially continuous stream.

In the described embodiment of the invention, the inlet and outlet conveyors 2, 4 are substantially straight. However, it will be appreciated that the inlet and/or outlet conveyors 2, 4 may be curved (when viewed from above). In this case, the respective longitudinal axes of the inlet and/or outlet conveyors 2, 4 will be curved. It is not necessary that the inlet and outlet conveyors 2, 4 have a common longitudinal axis. In addition, the inlet and outlet conveyors 2, 4 may not be substantially vertically aligned (although this is preferable) and may be of different widths.

The first and second conveyors 11, 12 of the outlet conveyor 4 may be of different widths and may not be substantially vertically aligned (although this is preferable). The upper and lower conveyors 11*a*, 11*b* of the first conveyor 11 may not be substantially aligned in the lateral direction and may be of different widths. Similarly, the upper and lower conveyors 12*a*, 12*b* of the second conveyor 12 may not be substantially aligned in the lateral direction and may be of different widths.

In the described embodiment the articles are substantially cylindrical cans. However, it will be appreciated that the articles may take different shapes and sizes and could be any type of article to be wrapped.

In the described embodiment the articles of fed to the inlet conveyor 2 by a feeder mechanism in the form of an elongate scroll (not shown). However, it will be appreciated that any suitable means of feeding articles to the inlet conveyor 2 in a substantially continuous stream may be used.

In the described embodiment the first and second conveyors 11, 12 of the outlet conveyor 4 each comprise upper and lower conveyors 11*a*, 11*b*, 12*a*, 12*a*. It will be appreciated that, although this is not preferred, the first and/or second conveyors 11, 12 may only comprise one of the upper or lower conveyors. For example, the first and second conveyors 11, 12 may comprise upper or lower conveyors only, the first conveyor may comprise an upper conveyor only and the second conveyor a lower conveyor only or vice versa, etc. However, it is preferred that the first and second conveyors 11, 12 each comprise upper and lower conveyors 11*a*, 11*b*, 12*a*, 12*a*, as this prevents unwanted separation of the articles on the first and second conveyors 11, 12.

Furthermore, it will be appreciated that the upper and/or lower conveyors 11, 12 may be arranged in different orientations relative to the articles. For example, they may be arranged to contact the sides of the articles (as opposed to the upper and lower surfaces of the articles).

It will also be appreciated that the longitudinal (and lateral) positioning of the sensors 13, 14, 16 may be varied, with consequential adjustments made to the distance and time terms in the above equations so as to account for this.

In the described embodiment the sensors 13, 14, 16 are optical sensors that arranged to detect when a leading or trailing edge of an article passes the sensor. However, it will be appreciated that any suitable type of sensor may be used, including a photodiode array, an infrared proximity sensor, etc.

Each collation of articles may comprise one or more articles, or lateral rows of articles. Preferably each collation of articles comprises a plurality of articles, or lateral rows of articles.

The described and illustrated embodiments are to be considered as illustrative and not restrictive in character, it being understood that only the preferred embodiments have been shown and described and that all changes and modifications that come within the scope of the inventions as defined in the claims are desired to be protected. It should be understood that while the use of words such as "preferable", "preferably", "preferred" or "more preferred" in the description suggest that a feature so described may be desirable, it may nevertheless not be necessary and embodiments lacking such a feature may be contemplated as within the scope of the invention as defined in the appended claims. In relation to the claims, it is intended that when words such as "a," "an," "at least one," or "at least one portion" are used to preface a feature there is no intention to limit the claim to only one such feature unless specifically stated to the contrary in the claim. When the language "at least a portion" and/or "a portion" is used the item can include a portion and/or the entire item unless specifically stated to the contrary.

The invention claimed is:

1. A packaging apparatus comprising:

a wrapping material applicator for helically wrapping articles;

an inlet conveyor for transporting unwrapped articles to the applicator;

an outlet conveyor for transporting wrapped articles away from the applicator, wherein the outlet conveyor comprises a first conveyor, and a second conveyor adjacent to and downstream of the first conveyor; and a controller arranged to selectively vary the linear velocity of the second conveyor relative to the linear velocity of the first conveyor so as to separate, or increase the separation of, collations of one or more articles on the outlet conveyor;

wherein the controller is arranged to carry out a method comprising the following steps:

1) the linear velocity ($V_2$) of the second conveyor is set to and maintained at substantially the linear velocity of the first conveyor ($V_1$), whereby a collation (n) of one or more articles ($A_1^n$ to $A_W^n$) is at least partially received by the second conveyor from the first conveyor;

2) once a proportion 'z' (where $0<z\leq 1$) of the length ($L_W^n$) of the last article ($A_W^n$), or the last lateral row of articles, of the collation (n) is received by the second conveyor, the linear velocity ($V_2$) of the second conveyor is increased to a value $V_{2inc}$; and 3) the second conveyor is maintained at the increased value ($V_{2inc}$) until the first article, or lateral row of articles, of the next upstream collation ($A_1^{n+1}$) reaches the upstream end of the second outlet conveyor, so as to produce a gap of a desired length (G) between the last article ($A_W^n$), or the last lateral row of articles, of the collation (n), and the first article, or the first lateral row of articles, of the next upstream collation ($A_1^{n+1}$) at this point in time, following which the sequence returns to the first step (with n=n+1).

2. A packaging apparatus according to claim 1, wherein said three steps are repeated in sequence for each collation of one or more articles ($A_x^y$) so as to separate the remaining upstream articles ($A_x^y$) into separate collations spaced apart by a gap (G).

3. A packaging apparatus according to claim 1, wherein the changes in the linear velocity of the second outlet conveyor $V_2$ from $V_1$ to $V_{2inc}$ and back again are step changes in velocity.

4. A packaging apparatus according to claim 1, wherein for each collation (n), the time ($T_{V1}$) for which the linear velocity ($V_2$) of the second conveyor is maintained at the linear velocity of the first conveyor ($V_1$) is calculated by:

$$T_{V1} = \frac{L_1^n + L_2^n + \ldots L_{W-1}^n + (z \times L_W^n)}{V_1}$$

where $L_x^y$ is the length of each article, or lateral row of articles, (x) of each collation (n).

5. A packaging apparatus according to claim 1, wherein for each collation (n) the time ($T_{V2inc}$) that the second conveyor is maintained at the increased value ($V_{2inc}$) is calculated by the central processing unit from the equation:

$$T_{V2inc} = \frac{L_W^n \times (1 - z)}{V_1}$$

where $L_x^y$ is the length of each article, or lateral row of articles, (x) of each collation (n).

6. A packaging apparatus according to claim 1, wherein $V_{2inc}$ is calculated by the central processing unit from the equation:

$$V_{2inc} = V_1 * \left(1 + \frac{G}{L_W^n(1 - z)}\right)$$

where G is the length of the gap between the last article ($A_W^n$), or the last lateral row of articles, of the collation (n), and the first article, or the first lateral row of articles, of the next upstream collation ($A_1^{n+1}$).

7. A packaging apparatus comprising:

a wrapping material applicator for helically wrapping articles;

an inlet conveyor for transporting unwrapped articles to the applicator;

an outlet conveyor for transporting wrapped articles away from the applicator, wherein the outlet conveyor comprises a first conveyor, and a second conveyor adjacent to and downstream of the first conveyor; and a controller arranged to selectively vary the linear velocity of the second conveyor relative to the linear velocity of the first conveyor so as to separate, or increase the separation of, collations of one or more articles on the outlet conveyor;

wherein the packaging apparatus comprises a cutting member arranged to cut wrapping material extending between the spaced collations of articles, as gaps between the collations pass the cutting member, so as to disconnect the spaced collations of articles.

8. A packaging apparatus according to claim 7, wherein the packaging apparatus further comprises at least one sensor arranged to sense the position and/or length of the articles.

9. A packaging apparatus according to claim 8, wherein the controller is arranged to selectively vary the linear velocity of the second conveyor relative to the linear velocity of the first conveyor in dependence on the sensed positions and/or lengths of the articles, so as to separate, or increase the separation of collations of one or more articles on the outlet conveyor.

10. A packaging apparatus according to claim 9, wherein the at least one sensor is connected to the controller via a central processing unit, and wherein the at least one sensor is arranged to determine the points in time at which leading and trailing edges of the articles pass a certain point and the central processing unit is arranged to calculate the lengths of the articles, from these time values.

11. A packaging apparatus according to claim 7, wherein the wrapping material is of a material that is sufficiently stretchable in the longitudinal direction to allow the collations to be spaced apart by said gap.

12. A packaging apparatus according to claim 7, wherein the packaging apparatus comprises at least one gap detector sensor arranged to detect whether or not there is gap between collations of articles on the second conveyor immediately prior to the gap passing the cutting station and connected to the controller via a central processing unit arranged such that if the gap is not detected to be in the correct location, then the cutting member is not operated to cut.

13. A packaging apparatus according to claim 7, wherein packaging apparatus comprises a discharge conveyor disposed downstream of and adjacent to the second conveyor of the outlet conveyor such that collations of articles on the second conveyor pass on to the discharge conveyor.

14. A packaging apparatus according to claim 13, wherein a gap is provided between the discharge conveyor and the second conveyor and the cutting member is disposed such that it cuts within said gap.

15. A packaging apparatus according to claim 7, wherein the first and second conveyors are movable relative to each other such that a gap between the first and second conveyors is variable.

16. A packaging apparatus according to claim 7, wherein each of the first and/or second conveyors comprises a pair of opposed spaced apart conveyors for receiving the articles between them, said opposed conveyors being movable relative to each other so as to vary their spacing so as to accommodate different sized articles.

17. A packaging apparatus according to claim 16, wherein the opposed conveyors are arranged to apply a frictional grip to the articles on the conveyors such that unwanted separation of articles on the conveyors, as the linear velocity of the second conveyor is selectively varied relative to the linear velocity of the first conveyor, is substantially prevented.

18. A method for helically wrapping together a collation of articles, the method comprising:

transporting unwrapped articles to a wrapping applicator with an inlet conveyor;

helically wrapping the collations of articles with wrapping material by operating the wrapping applicator;

conveying wrapped collations of articles away from the applicator with an outlet conveyor, wherein the outlet conveyor comprises a first conveyor and a second conveyor adjacent to and downstream of the first conveyor, and wherein the linear velocity of the second conveyor relative to the linear velocity of the first conveyor is selectively varied so as to separate, or increase the separation of, collations of one or more articles on the outlet conveyor; and cutting wrapping material, with a cutting member, extending between the spaced collations of articles, as gaps between the collations pass the cutting member, to disconnect the spaced collations of articles.

19. A method according to claim 18 wherein the method comprises the following steps:

a. the linear velocity ($V_2$) of the second conveyor is set to and substantially maintained at the linear velocity of the first conveyor ($V_1$), whereby a collation (n) of one or more articles ($A_1^n$ to $A_W^n$) is at least partially received by the second conveyor from the first conveyor;

b. once a proportion 'z' (where $0<z\leq1$) of the length ($L_W^n$) of the last article ($A_W^n$), or the last lateral row of articles, of the collation (n) is received by the second conveyor, the linear velocity ($V_2$) of the second conveyor is increased to a value $V_{2inc}$; and c. the second conveyor is maintained at the increased value ($V_{2inc}$) until the first article, or lateral row of articles, of the next upstream collation ($A_1^{n+1}$) reaches the upstream end of the second outlet conveyor, so as to produce a gap of a desired length (G) between the last article ($A_W^n$), or the last lateral row of articles, of the collation (n), and the first article, or the first lateral row of articles, of the next upstream collation ($A_1^{n+1}$) at this point in time, following which the sequence returns to the first step (with n=n+1).

* * * * *